US006432267B1

(12) United States Patent
Watson

(10) Patent No.: US 6,432,267 B1
(45) Date of Patent: Aug. 13, 2002

(54) WET CREPE, IMPINGEMENT-AIR DRY PROCESS FOR MAKING ABSORBENT SHEET

(75) Inventor: Gary M. Watson, Vancouver, WA (US)

(73) Assignee: Georgia-Pacific Corporation, Atlanta, GA (US)

( * ) Notice: Subject to any disclaimer, the term of this patent is extended or adjusted under 35 U.S.C. 154(b) by 0 days.

(21) Appl. No.: 09/733,172

(22) Filed: Dec. 8, 2000

Related U.S. Application Data

(60) Provisional application No. 60/171,070, filed on Dec. 16, 1999.

(51) Int. Cl.[7] ..... B31F 1/12; F26B 3/02

(52) U.S. Cl. ..... 162/111; 162/113; 34/419; 34/413

(58) Field of Search ..... 162/111–113, 117, 162/116, 121, 109, 204–207, 359–361; 34/114, 115, 117, 120, 122, 391–395, 413–414, 418–419, 420; 264/282–284; 156/183

(56) References Cited

U.S. PATENT DOCUMENTS

| | | | | | |
|---|---|---|---|---|---|
| 1,641,739 | A | | 9/1927 | Cofrin | |
| 1,772,185 | A | | 8/1930 | Liebeck | |
| 3,203,850 | A | | 8/1965 | McCarty | 162/113 |
| 3,301,746 | A | | 1/1967 | Sanford et al. | 162/113 |
| 3,432,936 | A | | 3/1969 | Cole et al. | 34/6 |
| 3,507,745 | A | | 4/1970 | Fuerst | 162/281 |
| 3,812,000 | A | * | 5/1974 | Salvucci, Jr. et al. | |
| 3,891,500 | A | * | 6/1975 | KankaanpääÄ | 162/274 |
| RE28,459 | E | | 7/1975 | Cole et al. | 34/6 |
| 3,895,449 | A | * | 7/1975 | Chance et al. | 34/638 |
| 3,994,771 | A | | 11/1976 | Morgan, Jr. et al. | 162/113 |
| 4,102,737 | A | | 7/1978 | Morton | 162/113 |
| 4,166,001 | A | * | 8/1979 | Dunning et al. | 162/111 |
| 4,326,000 | A | * | 4/1982 | Roberts, Jr. | 428/153 |
| 4,356,059 | A | | 10/1982 | Hostetler | 162/111 |
| 4,529,480 | A | | 7/1985 | Trokhan | 162/109 |
| 5,087,324 | A | | 2/1992 | Awofeso | 162/111 |
| 5,232,555 | A | | 8/1993 | Daunais et al. | 162/193 |
| 5,336,373 | A | | 8/1994 | Scattolino et al. | 162/116 |
| 5,383,288 | A | * | 1/1995 | ILmarinen | 34/292 |
| 5,411,636 | A | | 5/1995 | Hermans et al. | 162/109 |
| 5,494,554 | A | | 2/1996 | Edwards et al. | 162/111 |
| 5,495,678 | A | * | 3/1996 | Ilmarinen et al. | 34/117 |
| 5,510,002 | A | | 4/1996 | Hermans et al. | 162/113 |
| 5,512,139 | A | | 4/1996 | Worcester | 162/111 |
| 5,607,551 | A | | 3/1997 | Farrington, Jr. et al. | 162/109 |
| 5,653,041 | A | * | 8/1997 | Ilmarinen et al. | 34/117 |
| 5,851,353 | A | | 12/1998 | Fiscus et al. | 162/113 |
| 5,865,955 | A | | 2/1999 | IlvespaA et al. | 162/207 |
| 5,891,309 | A | | 4/1999 | Page et al. | 162/281 |
| 5,968,590 | A | | 10/1999 | Ahonen et al. | 427/209 |
| 6,001,421 | A | | 12/1999 | Ahonen et al. | 427/316 |
| 6,003,241 | A | * | 12/1999 | Komulainen et al. | 34/117 |
| 6,004,430 | A | * | 12/1999 | Ilvespaa et al. | |
| 6,033,523 | A | * | 3/2000 | Dwiggins et al. | 162/111 |
| 6,101,735 | A | * | 8/2000 | Kuhasalo et al. | 34/117 |
| 6,119,362 | A | | 9/2000 | Sundqvist | 34/120 |
| 6,187,139 | B1 | * | 2/2001 | Edwards et al. | 162/111 |
| 6,197,154 | B1 | * | 3/2001 | Chen et al. | 162/109 |
| 6,210,528 | B1 | * | 4/2001 | Wolkowicz | 162/111 |

FOREIGN PATENT DOCUMENTS

| | | | |
|---|---|---|---|
| EP | 0851062 A2 | 7/1998 | D21H/21/22 |

OTHER PUBLICATIONS

Page et al., "A new concept for air or vapor impingement drying" Tappi Journal, Sep/. 1990,, pp–229–234.*

"Total Machine Concept and Considerations for Thru–AIr–Dried Tissue Paper", EUCEPA 24th Conf. Proc. F(Stockholm), Pap. Technol.: 310–320 (May 8–11, 1990), of B.K.G. Glifberg et al. "Economic Considerations in Through–Air–Drying", Pap. News (Valmet) 6, No. 1: 15–16 (1990), of R.A. Parker "Convective Heat Transfer Under Turbulent Impinging Slot Jet at Large Temperature Differences", Drying '85 (TIOe & Mujumdar, eds.)/Proc. Int. Drying Symp. (Kyoto) 4th: 354–359 (Jul. 9–12, 1984); c1985 HemiPShere Publ. Co.), of D. Das et al.

"Intensification of Paper Web Dewatering and Drying", Przeglad Papier, 45, No. 11:402–404 (Nov. 1979), of W. Kawka et al. "Some Problems of Blow–Through Drying of Porous Papers", Przeglad Papier 33, No. 8: 299–305 (Aug. 1977) of W. Kawka et al.

* cited by examiner

*Primary Examiner*—Jose Fortuna
(74) *Attorney, Agent, or Firm*—Michael W. Ferrell

(57) ABSTRACT

A wet crepe, impingement-air dried process for producing absorbent paper sheet is disclosed. In preferred embodiments, the process utilizes recycle furnish and the web is delaminated as it is wet-creped from a Yankee dryer. Particular embodiments include high consistency (after-crepe) wet-shaping prior to impingement air drying on a drilled vacuum roll.

38 Claims, 14 Drawing Sheets

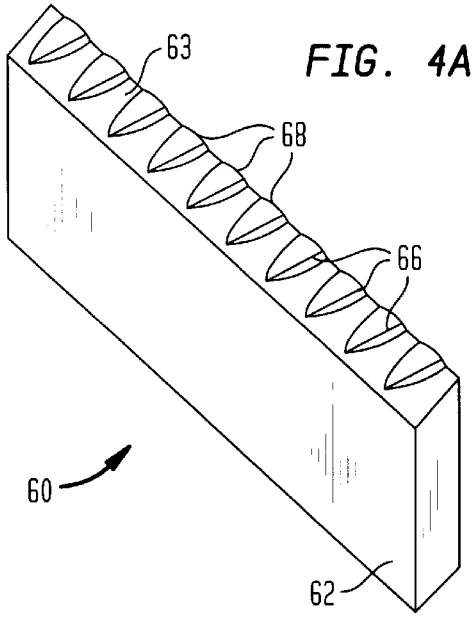
FIG. 4A
FIG. 4B
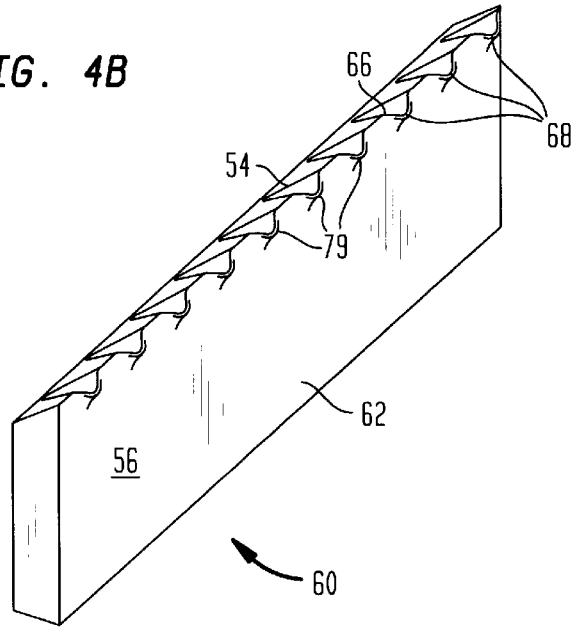
FIG. 4C
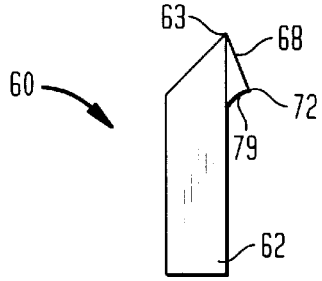

WET CREPE, IMPINGEMENT-AIR DRY PROCESS FOR MAKING ABSORBENT SHEET

CLAIM FOR PRIORITY

This application claims the benefit of the filing date of U.S. Provisional Patent Application Serial No. 60/171,070, filed Dec. 16, 1999.

TECHNICAL FIELD

The present invention relates to methods of making absorbent cellulosic sheet in general, and more specifically to a wet crepe process wherein a web is dewatered, thereafter creped and dried with an impinging gaseous stream on a rotating cylinder.

BACKGROUND

Wet crepe processes for making absorbent sheet, such as tissue and towel products, are known in the art. There is disclosed, for example, in U.S. Pat. No. 5,851,353 to Fiscus et al. a method for can drying wet webs for tissue products wherein a partially dewatered wet web is restrained between a pair of molding fabrics. The restrained wet web is processed over a plurality of can dryers, for example, from a consistency of about 40 percent to a consistency of at least about 70 percent. The sheet molding fabrics protect the web from direct contact with the can dryers and impart an impression on the web. Due to low heat transfer coefficients, can drying after a crepe operation can be expensive both in terms of operating costs and capital investment.

Other wet crepe processes, specifically wet crepe, through air dry processes have been suggested in the art and practiced commercially. One such process is described in U.S. Pat. No. 3,432,936 to Cole et al. The process disclosed in the '936 patent includes: forming a nascent web on a forming fabric; wet pressing the web; drying the web on a Yankee dryer; creping the web off of the Yankee dryer; and through air drying the product. Another wet crepe, through air dry process is suggested in U.S. Pat. No. 4,356,059 to Hostetler. In the '059 patent there is disclosed a process including: forming a nascent web on a forming fabric; drying the web on a can dryer; creping the web off of the can dryer; through air drying the web; applying the dry web to another Yankee dryer; creping the web from the Yankee dryer and calendaring the product.

Wet crepe, throughair dry processes have not met with substantial commercial success since the process rates, product quality and machine productivity simply could not meet the demanding cost/performance criteria required in the industry. Through dry processes generally require high permeability webs and are difficult to practice on a web that has been compactively dewatered or formed with a substantial portion of secondary (recycle) fiber.

SUMMARY OF INVENTION

There is provided in accordance with the present invention a method of making absorbent sheet by way of a wet-crepe process wherein the wet-creped web is after-dried with an impinging stream of heated air or a heated gas stream. Unlike through-dry processes, after drying with impinging air can be accomplished on a web with relatively low permeability if so desired and is thus suitable in processes for making paper tissue and towel products where a large proportion of secondary fiber is employed or the web is mechanically compressed. Inasmuch as the drying medium need not flow through the web, greater manufacturing flexibility is thus achieved on a single production line.

There is provided in one aspect of the present invention a method of making absorbent sheet from cellulosic fiber comprising the steps of: (a) depositing an aqueous cellulosic furnish on a foraminous support; (b) dewatering the furnish to form a cellulosic web; (c) applying the dewatered web to a heated rotating cylinder and drying the web to a consistency of greater than about 40 percent and less than about 80 percent; (d) creping the web from said heated cylinder at said consistency of greater than about 40 percent and less than about 80 percent, and optionally wet shaping the web such that the web is rendered suitable for impingement-air drying; and (d) drying said web with an impinging heated gaseous medium subsequent to creping the web from the heated cylinder to form said absorbent sheet.

The web is preferably dewatered to a consistency of at least about 30 percent prior to being applied to the heated cylinder, and more preferably, the web is dewatered to a consistency of at least about 40 percent prior to being applied to the heated cylinder. On the cylinder, the web is typically dried to a consistency of at least about 50 percent prior to being creped, and in many cases the web is dried to a consistency of at least about 60 percent prior to being creped. In some embodiments, the web is dried to a consistency of at least about 70 percent prior to being creped.

In preferred embodiments, the web is relatively highly bulked immediately after wet creping such that the web is open and can be efficiently dried with an impinging gaseous medium. Thus, the characteristic void volume (hereinafter defined) of the web immediately after creping is at least about 6 gms/gm, more preferably at least about 7 gms/gm and in some preferred embodiments exhibiting a characteristic void volume of at least about 7.5 gms/gm immediately after creping.

Creping methods useful in connection with the present invention include creping with conventional (beveled or unbeveled) crepe blades or, more preferably in some cases with an undulatory creping blade operative to impart a biaxially undulatory structure to the product. The web is generally creped from the heated cylinder with a creping blade defining a pocket angle of from about 50 to about 100 degrees, which blade (as noted above) may be a beveled creping blade. A pocket angle from about 65 to about 90 degrees may be preferred with a beveled blade have a bevel of from about 8 to about 12 degrees, or a bevel of from about 14 to about 18 degrees. When an undulatory creping blade is used, it is typically configured so as to form a reticulated biaxially undulatory product with crepe bars extending in the cross direction and ridges extending in the machine direction. The product of an undulatory wet crepe operation generally has from about 10 to about 150 crepe bars per inch, and from about 10 to about 50 ridges per inch extending in the machine direction.

The method of the present invention is suitably practiced wherein the aqueous furnish includes recycled fiber. The recycled fiber in the aqueous furnish may comprise at least about 50 percent by weight of the fiber present or may comprise at least about 75 percent by weight of the fiber present. In some embodiments, the cellulosic fiber present in the aqueous furnish consists entirely of recycled fiber.

The heated gaseous medium is typically heated by way of combustion or infra-red ("IR") radiation or combinations thereof.

The web may be wet-shaped subsequent to creping and prior to being dried with impinging air by way of vacuum-molding in an impression fabric.

In another aspect of the present invention, there is provided a method of making absorbent sheet from cellulosic fiber comprising: (a) depositing an aqueous cellulosic furnish on a foraminous support; (b) compactively dewatering the furnish to form a web; (c) applying the web to a heated rotating cylinder; (d) maintaining the surface of the rotating cylinder at an elevated temperature relative to its surroundings so as to produce a moisture gradient over the thickness of the web; (e) drying the web on the cylinder to a consistency of between about 40 and about 80 percent; (f) creping the web from said cylinder, wherein the creping is operative to delaminate the web and optionally wet-shaping the web wherein said web is suitable for impingement-air drying; and (g) drying the web with an impinging gaseous medium to form a finished product. The surface of the heated cylinder is generally maintained at a temperature of from about 150° F. to about 300° F., while the side of the web adjacent to heated cylinder is between about 180 degrees F. and 230 degrees F. upon creping. In some embodiments, steam is supplied to the heated cylinder at a pressure of from about 50 to about 150 psig, whereas steam is preferably supplied to the heated cylinder at a pressure of at least about 100 psig in many embodiments.

The step of drying the web with the impinging drying medium may comprise passing the web through at least one single-wire draw dryer group after creping, each of the at least one single-wire dryer group including first and second rows of web-supporting members and a single drying wire for carrying the web alternating between one of the members in the first row and one of the members in the second row; arranging an impingement-drying device in opposed relationship to at least one of the members in the at least one single-wire draw dryer group; and directing heated air from the impingement-drying device toward the web as the web runs over the at least one member. Typically, members in the first row in a first one of the at least one single-wire draw dryer group in a running direction of the web constitute reversing cylinders and the members in the second row in said first single-wire draw dryer group constitute drying cylinders. The process may further include: arranging the second row of drying cylinders below said first row of reversing cylinders such that said first single-wire draw dryer group constitutes an inverted single-wire draw dryer group; the impingement-drying device being arranged in opposed relationship to at least one of the reversing cylinders in the first row of the inverted single-wire draw dryer group; guiding the web after creping initially over a first one of the drying cylinders in the second row of the inverted single-wire draw dryer group; and passing the web from the inverted single-wire draw dryer group into a twin-wire draw dryer group including first and second rows of drying cylinders, a first drying wire for carrying the web over the first row of drying cylinders and a second drying wire for carrying the web over the second row of drying cylinders. In some embodiments, impinging air is heated to a temperature of from about 150° F. to about 300° F.

In still further aspects of the invention, there are provided absorbent sheet products made by way of the inventive processes.

BRIEF DESCRIPTION OF THE DRAWINGS

The invention is described in detail below in connection with numerous embodiments and drawings. In the drawings:

FIGS. 4A, 4B, and 4C illustrate perspective views of an undulatory creping blade of the patented undulatory blade used in producing the absorbent product of the present invention;

DETAILED DESCRIPTION

The present invention is directed in a first aspect to an improved method of making a paper product having improved processability, bulk, absorbency and softness. The paper product according to the present invention can be manufactured on any papermaking machines of conventional forming configuration if so desired, or on a machine particularly adapted for high speed manufacture of wet creped products as described herein.

Figure 1:
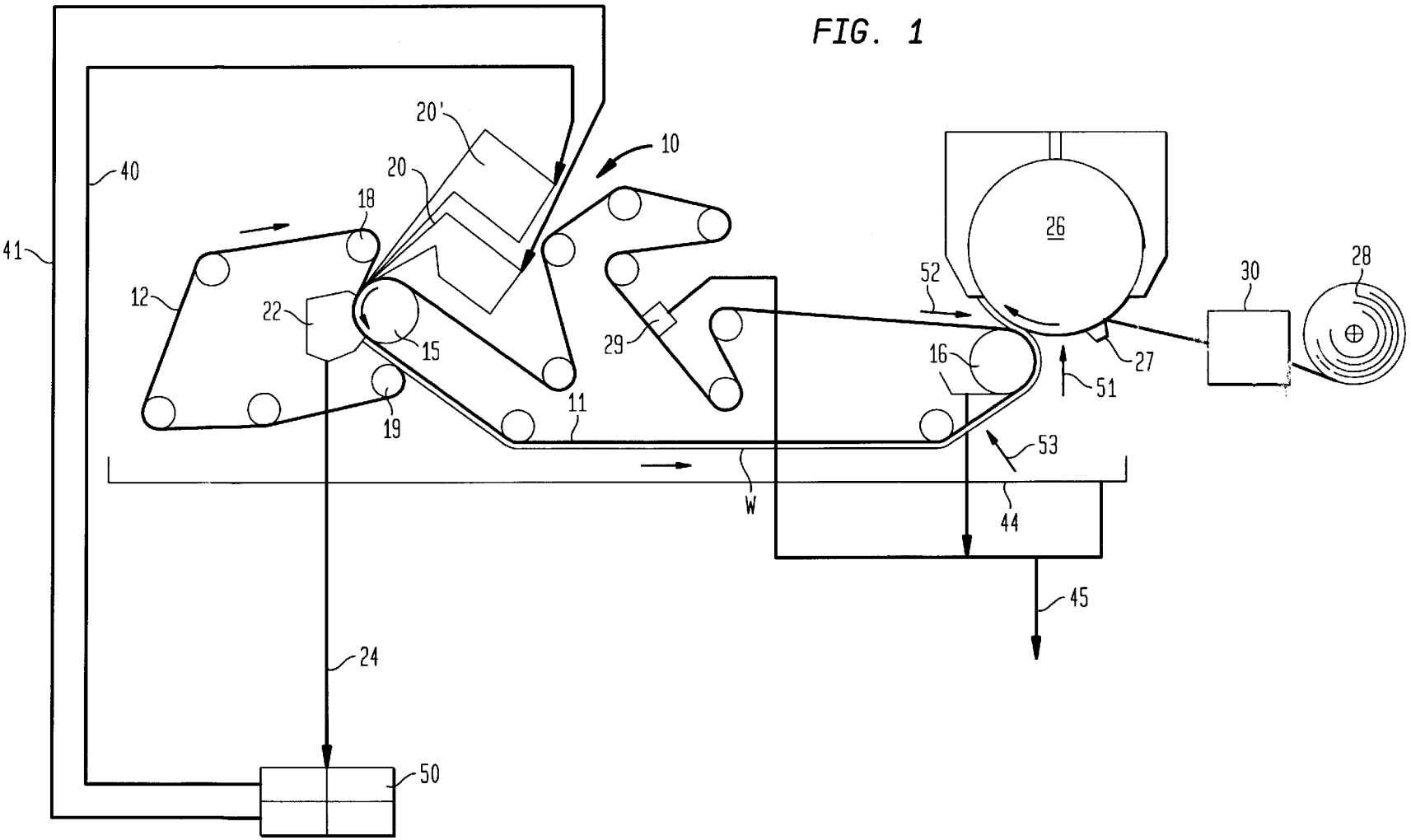
FIG. 1 illustrates one crepe apparatus that may be used according to the present invention.

FIG. 1 illustrates an embodiment of the present invention where a machine chest 50, which may be compartmentalized, is used for preparing furnishes that are treated with chemicals having different functionality depending on the character of the various fibers used. This embodiment shows two head boxes thereby making it possible to produce a stratified product. The product according to the present invention can be made with single or multiple head boxes and regardless of the number of head boxes may be stratified or unstratified. The treated furnish is transported through different conduits 40 and 41, where they are delivered to the head box of a crescent forming machine 10.

FIG. 1 shows a web-forming end or wet end with a liquid permeable foraminous support member 11 which may be of any conventional configuration. Foraminous support member 11 may be constructed of any of several known materials including photopolymer fabric, felt, fabric, or a synthetic filament woven mesh base with a very fine synthetic fiber batt attached to the mesh base. The foraminous support member 11 is supported in a conventional manner on rolls, including breast roll 15 and couch or pressing roll, 16.

Forming fabric 12 is supported on rolls 18 and 19 which are positioned relative to the breast roll 15 for pressing the press wire 12 to converge on the foraminous support member 11. The foraminous support member 11 and the wire 12 move in the same direction and at the same time speed which is the same direction of rotation of the breast roll 15. The pressing wire 12 and the foraminous support member 11 converge at an upper surface of the forming roll 15 to form a wedge-shaped space or nip into which one or more jets of water or foamed liquid fiber dispersion is pressed between the pressing wire 12 and the foraminous support member 11 to force fluid through the wire 12 into a saveall 22 where it is collected to reuse in the process.

The nascent web W formed in the process is carried by the foraminous support member 11 to the pressing roll 16 where the next nascent web W is transferred to the drum 26 of a Yankee dryer. Fluid is pressed from the web W by pressing roll 16 as the web is transferred to the drum 26 of a dryer where it is partially dried and creped by means of a creping blade 27. The web then transferred to an additional drying section 30 to complete the drying of the web, prior to being collected on a take-up roll 28. The drying section 30 is illustrated and described hereinafter in connection with FIGS. 10, 11, 12, 13, 14 and 15.

A pit 44 is provided for collecting water squeezed from the furnish by the press roll 16 and a Uhle box 29. The water collected in pit 44 may be collected into a flow line 45 for separate processing to remove surfactant and fibers from the water and to permit recycling of the water back to the papermaking machine 10.

According to the present invention, an absorbent paper web can be made by dispersing fibers into aqueous slurry and depositing the aqueous slurry onto the forming wire of a paper making machine. Any art recognized forming scheme might be used. For example, an extensive but non-exhaustive list includes a crescent former, a C-wrap twin wire former, an S-wrap twin wire former, a suction breast roll former, a Fourdrinier former, or any art recognized forming configuration. The particular forming apparatus is not critical to the success of the present invention. The forming fabric can be any art recognized foraminous member including single layer fabrics, double layer fabrics, triple layer fabrics, photopolymer fabrics, and the like. Non-exhaustive background art in the forming fabric area include U.S. Pat. Nos. 4,157,276; 4,605,585; 4,161,195; 3,545,705; 3,549,742; 3,858,623; 4,041,989; 4,071,050; 4,112,982; 4,149,571; 4,182,381; 4,184,519; 4,314,589; 4,359,069; 4,376,455; 4,379,735; 4,453,573; 4,564,052; 4,592,395; 4,611,639; 4,640,741; 4,709,732; 4,759,391; 4,759,976; 4,942,077; 4,967,085; 4,998,568; 5,016,678; 5,054,525; 5,066,532; 5,098,519; 5,103,874; 5,114,777; 5,167,261; 5,199,261; 5,199,467; 5,211,815; 5,219,004; 5,245,025; 5,277,761; 5,328,565; and 5,379,808 all of which are incorporated herein by reference in their entirety. The particular forming fabric is not critical to the success of the present invention. One forming fabric found particularly useful with the present invention is Appleton Mills Forming Fabric 2184 made by Appleton Mills Forming Fabric Corporation, Florence, Miss.

Paper making fibers used to form the absorbent products of the present invention include cellulosic fibers commonly referred to as wood pulp fibers, liberated in the pulping process from softwood (gymnosperms or coniferous trees) and hardwoods (angiosperms or deciduous trees). Cellulosic fibers from diverse material origins may be used to form the web of he present invention. These fibers include non-woody fibers liberated from sugar cane, bagasse, sabai grass, rice straw, banana leaves, paper mulberry (i.e., bast fiber), abaca leaves, pineapple leaves, esparto grass leaves, and fibers from the genus hesperaloe in the family Agavaceae. Also recycled fibers which may contain of the above fiber sources in different percentages, can be used in the present invention. Suitable fibers are disclosed in U.S. Pat. Nos. 5,320,710 and 3,620,911, both of which are incorporated herein by reference.

Paper making fibers can be liberated from their source material by any one of the number of chemical pulping processes familiar to one experienced in the art including sulfate, sulfite, polysulfide, soda pulping, etc. The pulp can be bleached if desired by chemical means including the use of chlorine, chlorine dioxide, oxygen, etc. Furthermore, paper making fibers can be liberated from source material by any one of a number of mechanical/chemical pulping processes familiar to anyone experienced in the art including mechanical pulping, thermomechanical pulping, and chemithermomechanical pulping. These mechanical pulps can be bleached, if necessary, by a number of familiar bleaching schemes including alkaline peroxide and ozone bleaching.

Fibers for use according to the present invention may also be procured recycling of pre-and post-consumer paper products. Fiber may be obtained, for example, from the recycling of printers' trims and cuttings, including book and clay coated paper, post consumer paper including office and curbside paper recycling including old newspaper.

The various collected paper can be recycled using means common to recycled paper industry. The papers may be sorted and graded prior to pulping in conventional low-, mid-, and high-consistency pulpers. In the pulpers the papers are mixed with water and agitated to break the fibers free from the sheet. Chemicals common to the industry may be added in this process to improve the dispersion of the fibers in the slurry and to improve the reduction of contaminants that may be present. Following pulping, the slurry is usually passed through various sizes and types of screens and cleaners to remove the larger solid contaminants while retaining the fibers. It is during this process that such waste contaminants as paper clips and plastic residuals are removed.

The pulp is then generally washed to remove smaller sized contaminants consisting primarily of inks, dyes, fines and ash. This process is generally referred to as deinking. Deinking, in the modem sense, refers to the process of making useful pulp from wastepaper while removing an ever increasing variety of objectionable, noncellulosic materials.

One example of a deinking process by which recycled fiber for use in the present invention can be obtained is called floatation. In this process small air bubbles are introduced into a column of the furnish. As the bubbles rise they tend to attract small particles of dye and ash. Once upon the surface of the column of stock they are skimmed off. At this point the pulp may be relatively clean but is often low in brightness. Paper made from this stock can have a dingy, gray appearance, not suitable for near-premium product forms.

To increase the brightness the furnish is often bleached. Bleaching can be accomplished by a number of means including, but not limited to, bleaching with chlorine, hypochlorite, chlorine dioxide, oxygen, peroxide, hydrosulfite, or any other commonly used bleaching agents. The types and amounts of bleaching agents depend a great deal on the nature of the wastepaper being processed and upon the level of desired brightness. Generally speaking, unbleached waste papers can have brightness levels between 60 to 80 on the G.E. brightness scale, depending upon the quality of the paper being recycled. Bleached waste papers can range between the same levels and may extend up to about 90, however, this brightness level is highly dependent upon the nature of the waste papers used.

Since the cost of waste paper delivered to the pulp processing plant is related to the cleanliness and quality of the fibers in the paper, it is advantageous to be able to upgrade relatively low cost waste papers into relatively high value pulp. However, the process to do this can be expensive not only in terms of machinery and chemical costs but also in lost yield. Yield is defined as the percentage by weight of the waste paper purchased that finally ends up as pulp produced. Since the lower cost waste papers generally contain more contaminants, especially relatively heavy clays and fillers generally associated with coated and writing papers, removal of these contaminants can have a dramatic effect on the overall yield of pulp obtainable. Low yields also translate into increased amounts of material that must be disposed of in landfills or by other means.

In addition, as the ash levels are reduced, fines, and small fibers are lost since there is currently no ash-specific removal process in use which removes only ash without taking small fibers and fines. For example, if a pulp of 70 percent yield can be used rather than a "cleaner" 50 percent yield the savings in pulp cost due to more fiber and less waste removal is significant.

Generally, premium grade products are not made using a major amount of secondary recycle fibers, let alone being made predominately or entirely from secondary recycle fibers. Recycled fibers suffer from problems with low brightness requiring the addition of virgin fibers; and slow furnish de-watering resulting in poor drainage on the forming wire and necessitating slower machine speeds. Base sheets made by conventional means with a high percentage or 100 percent recycled fibers are very dense. Therefore, their strength does not break down as much during creping. This results in harsh, high strength, creped paper. In conventional processes it has been understood that to include recycle fibers, it is necessary to preprocess the fibers to render them substantially free from ash. This inevitably increases cost. Failing to remove the ash is believed to create often insurmountable problems with drainage or formation. If sufficient water is added to the stock to achieve good formation, the forming wires often flood. If the water is reduced to prevent this flooding problem, there are often severe problems in forming a substantially homogeneous web.

Furnishes utilized according to the present invention may contain significant amounts of secondary fibers that possess significant amounts of ash and fines. It is common in the industry to hear the term ash associated with virgin fibers. This is defined as the amount of ash that would be created if the fibers were burned. Typically no more than about 0.1% to about 0.2% ash is found in virgin fibers. Ash as used in the present invention includes this "ash" associated with virgin fibers as well as contaminants resulting from prior use of the fiber. Furnishes utilized in connection with the present invention may include excess of amounts of ash greater than about 1% or more. Ash originates when fillers or coatings are added to paper during formation of a filled or coated paper product. Ash will typically be a mixture containing titanium dioxide, kaolin clay, calcium carbonate and/or silica. This excess ash or particulate matter is what has traditionally interfered with processes using recycle fibers, thus making the use of recycled fibers unattractive. In general recycled paper containing high amounts of ash is priced substantially lower than recycled papers with low or insignificant ash contents. Thus, there will be a significant advantage to a process for making a premium or near-premium product from recycled paper containing excess amounts of ash.

Furnishes containing excess ash also typically contain significant amount of fines. Ash and fines are most often associated with secondary, recycled fibers, post-consumer paper and converting broke from printing plants and the like. Secondary, recycled fibers with excess amounts of ash and significant fines are available on the market and are quite cheap because it is generally accepted that only very thin, rough, economy towel and tissue products can be made unless the furnish is processed to remove the ash. The present invention makes it possible to achieve a paper product with high void volume and premium or near-premium qualities from secondary fibers having significant amounts of ash and fines without any need to preprocess the fiber to remove fines and ash. While the present invention contemplates the use of fiber mixtures, including the use of virgin fibers, fiber in the products according to the present invention may have greater than 0.75% ash, and sometimes more than 1% ash. The fiber may have greater than 2% ash and may even have as high as 30% ash or more.

As used herein, fines constitute material within the furnish that will pass through a 100 mess screen. Ash and ash content is defined as above and can be determined using TAPPI Standard Method T211 OM93.

The suspension of fibers or furnish may contain chemical additives to alter the physical properties of the paper produced. These chemistries are well understood by the skilled artisan and may be used in any known combination.

The pulp can be mixed with strength adjusting agents such as wet strength agents, dry strength agents and debonders/softeners. Suitable wet strength agents will be readily apparent to the skilled artisan. A comprehensive but non-exhaustive list of useful strength aids include urea-formaldehyde resins, melamine formaldehyde resins, glyoxylated polyacrylamide resins, polyamide-epichlorohydrin resins and the like. Thermosetting polyacrylamides are produced by reacting acrylamide with diallyl dimethyl ammonium chloride (DADMAC) to produce a cationic polyacrylamide copolymer which is ultimately reacted with glyoxal to produce a cationic cross-linking wet strength resin, glyoxylated polyacrylamide. These materials are generally described in U.S. Pat. No. 3,556,932 to Coscia et al. and U.S. Pat. No. 3,556,933 to Williams et al., both of which are incorporated herein by reference in their entirety. Resins of this type are commercially available under the trade name of PAREZ 631NC by Cydec Industries. Different mole ratios of acrylamide/DADMAC/glyoxal can be used to produce cross-linking resins, which are useful as wet strength agents. Furthermore, other dialdehydes can be substituted for glyoxal to produce thermosetting wet strength characteristics. Of particular utility are the polyamide-epichlorohydrin resins, an example of which is sold under the trade names Kymene 557LXX and Kymene 557H by Hercules Incorporated of Wilmington, Del. and CASCAMID® from Borden Chemical Inc. These resins and the process for making the resins are described in U.S. Pat. Nos. 3,700,623 and 3,772,076 each of which is incorporated herein by reference in its entirety. An extensive description of polymeric-epihalohydrin resins is given in Chapter 2: *Alkaline-Curing Polymeric Amine-Epichlorohydrin* by Espy in *Wet Strength Resins and Their Application* (L. Chan, Editor, 1994), herein incorporated by reference in its entirety. A reasonably comprehensive list of wet strength resins is described by Westfelt in *Cellulose Chemistry and Technology*, Volume 13, p. 813, 1979, which is incorporated herein by reference.

Suitable dry strength agents will be readily apparent to one skilled in the art. A comprehensive but non-exhaustive list of useful dry strength aids includes starch, guar gum, polyacrylamides, carboxymethyl cellulose and the like. Of particular utility is carboxymethyl cellulose, an example of which is sold under the trade name Hercules CMC by Hercules Incorporated of Wilmington, Del.

Suitable debonders will be readily apparent to the skilled artisan. Debonders or softeners may also be incorporated into the pulp or sprayed upon the web after its formation. The present invention may also be used with softener materials within the class of amido amine salts derived from partially acid neutralized amines. Such materials are disclosed in U.S. Pat. No. 4,720,383. Evans, *Chemistry and Industry*, Jul. 5, 1969, pp.893–903; Egan. *J.Am. Oil Chemist's Soc., Vol.* 55 (1978), pp. 118–121; and Trivedi et al., *J.Am.Oil Chemist's Soc.*, June 1981, pp.754–756, incorporated by reference in their entirety, indicate that softeners are often available commercially only as complex mixtures rather than as single compounds. While the following discussion will focus on the predominant species, it should be understood that commercially available mixtures would generally be used in practice.

Quasoft 202-JR is a suitable softener material, which may be derived by alkylating a condensation product of oleic acid and diethylenetriamine. Synthesis conditions using a deficiency of alkylation agent (e.g., diethyl sulfate) and only one alkylating step, followed by pH adjustment to protonate the non-ethylated species, result in a mixture consisting of cationic ethylated and cationic non-ethylated species. A minor proportion (e.g., about 10%) of the resulting amido amine cyclize to imidazoline compounds. Since only the imidazoline portions of these materials are quaternary ammonium compounds, the compositions as a whole are pH-sensitive. Therefore, in the practice of the present invention with this class of chemicals, the pH in the head box should be approximately 6 to 8, more preferably 6 to 7 and most preferably 6.5 to 7.

Quaternary ammonium compounds, such as dialkyl dimethyl quaternary ammonium salts are also suitable particularly when the alkyl groups contain from about 14 to 20 carbon atoms. These compounds have the advantage of being relatively insensitive to pH.

Biodegradable softeners can be utilized. Representative biodegradable cationic softeners/debonders are disclosed in U.S. Pat. Nos. 5,312,522; 5,415,737; 5,262,007; 5,264,082; and 5,223,096, all of which are incorporated herein by reference in their entirety. The compounds are biodegradable diesters of quaternary ammonia compounds, quaternized amine-esters, and biodegradable vegetable oil based esters functional with quaternary ammonium chloride and diester dierucyldimethyl ammonium chloride and are representative biodegradable softeners.

The fibrous web is then preferably deposited on a de-watering felt and water is mechanically (compactively) removed from the web. Any art recognized fabrics or felts could be used with the present invention. For example, a non-exhaustive list of impression fabrics would include plain weave fabrics described in U.S. Pat. No. 3,301,746; semi-twill fabrics described in U.S. Pat. Nos. 3,974,025 and 3,905,863; bilaterally-staggered-wicker-basket cavity type fabrics described in U.S. Pat. Nos. 4,239,065 and 4,191,609; sculptured/load bearing layer type fabrics described in U.S. Pat. No. 5,429,686; photopolymer fabrics described in U.S. Pat. Nos. 4,529,480; 4,637,859; 4,514,345; 4,528,339; 5,364,504; 5,334,289; 5,275,799; and 5,260,171; and fabrics containing diagonal pockets described in U.S. Pat. No. 5,456,293. The aforementioned patents are incorporated herein by reference, in their entirety. Any art-recognized-felt can be used with the present invention. For example, felts can have double-layer base weaves, triple-layer base weaves, or laminated base weaves. Preferred felts according to the present invention are those having the laminated base weave design. A wet-press-felt found particularly useful with the present invention is AMFlex 3 made by Appleton Mills Corporation. Non-exhaustive background art in the press felt area includes U.S. Pat. Nos. 5,657,797; 5,368,696; 4,973,512; 5,023,132; 5,225,269; 5,182,164; 5,372,876; and 5,618,612, all of which are incorporated herein by reference in their entirety.

While the product according to the present invention is preferably made by wet pressing in connection with a felt as described above, it is possible to thermally pre-dry the web. In this respect, suitable machinery and process conditions for pre-drying and wet-shaping the web prior to applying the web to a Yankee dryer are found in the following patents, the disclosures of which are hereby incorporated by reference in their entirety. U.S. Pat. No. 3,994,771 to Morgan, Jr. et al.; U.S. Pat. No. 4,102,737 to Morton; U.S. Pat. No. 4,529,480 to Trokhan and U.S. Pat. No. 5,510,002 to Hermans et al.

Any art recognized means for forming a nascent web that has a solids content of 30 to 90% upon creping from a dryer is fully suitable for use in the present invention. This may include transfer of the nascent web from the forming fabric to an impression fabric prior to application of the nascent web to the dryer from which it will be creped. As stated, the preferred drying method is conventional wet pressing, i.e., on a pressing felt, followed by adherence to a Yankee dryer.

The web is adhered to the Yankee dryer by nip transfer by pressing. The transfer may be accomplished by any art recognized method including, but not limited to, press rolls and belts. The machine configuration used to transfer the web to the Yankee can be any method that allows one to adhere the web to the dryer and create a profile that causes delamination upon creping. While the specification generally makes reference to the dryer from which the web is creped as a Yankee dryer, it should be understood that any dryer from which the web can be used. One example of an alternative configuration would include the use of an impulse drying wide-shoe press against a heated back roll.

Any suitable art recognized adhesive might be used on the Yankee dryer. Preferred adhesives include polyvinyl alcohol with suitable plasticizers, glyoxylated polyacrylamide with or without polyvinyl alcohol, and polyamide epichlorohydrin resins such as Quacoat A-252 (QA252), Betzcreplus 97 (Betz+97) and Calgon 675 B. Suitable adhesives are widely described in the patent literature. A comprehensive but non-exhaustive list includes U.S. Pat. Nos. 5,246,544; 4,304,625; 4,064,213; 3,926,716; 4,501,640; 4,528,316; 4,788,243; 4,883,564; 4,684,439; 5,326,434; 4,886,579; 5,374,334; 4,440,898; 5,382,323; 4,094,718; 5,025,046; and 5,281,307. Typical release agents can be use in accordance with the present invention.

The adhesive is preferably added in an amount of greater than about 0.1 lbs/ton, more preferably greater than about 0.25 lbs/ton, and most preferably between about 0.5 and about 1.0 lb/ton.

The nascent web adhered to the dryer preferably has a solids content of from about 30 to about 90, more preferably from about 45 to about 75 and still more preferably from about 55 to about 65.

The temperature of the dryer from which the web is to be creped can be controlled to provide a moisture profile within the web that causes delamination of the web during creping.

In a preferred embodiment, the Yankee dryer temperature and the Yankee hood temperature are controlled to provide a moisture profile in the web which causes delamination of the fibers during creping. In one preferred embodiment, this delamination is achieved through the use of increased heat to the Yankee dryer and decreased heat to the Yankee hood. Conventionally, more heat is applied from the Yankee hood than from the Yankee dryer. Conventional operation causes drying of the web on both sides, resulting in acceptable dry creping. When the heat to the Yankee is increased and the heat form the hood is decreased, the primary heat source contacting the web is the Yankee dryer. This causes the Yankee side of the web to be at a higher temperature than the air side of the web. This also causes the Yankee side of the web to be dryer than the air side of the web. It is through the control of this moisture profile that delamination of the web occurs.

The Yankee dryer is preferably at a pressure of from about 50 to about 150 psi steam pressure, more preferably at pressure of from about 90 to about 150, and still more preferably at a pressure of from about 110 to about 150 psi. During wet creping the Yankee dryer side of the sheet immediately after creping is preferably at a temperature of from about 180 to about 230° F., more preferably at a temperature from about 195 to about 225° F. and most preferably at a temperature of from about 205 to about 220° F. (as measured by IR using an emissivity setting of about 0.85 to 0.9).

The side of the sheet away from the Yankee dryer, when measured under similar circumstance, exhibits a temperature of about 210° F. or less, more preferably about 200° F. or less, still more preferably less than about 190° F. Delamination is best affected when the temperature sidedness of the sheet measured just after creping is at least about 5° F., more preferably at least about 10° F., still more preferably at least about 20° F. In the case of the wide shoe press/impulse drying. This differential is best controlled by maintaining an outside side sheet temperature (while on the roll but before creping) of about 220 degrees or less. In maintaining the temperatures in this manner one can be assured that there is a moisture differential sufficient in the sheet to produce the delamination effect. This is believed to be based upon the roll side of the sheet being dry just prior to creping. The dryness of a single side can be determined by the temperature exhibited by the side of the web in contact with the Yankee dryer. Because of the very high heat possible using an impulse dryer, the extent to which the web needs to be wrapped around the heated roll can be minimized to better control this temperature differential. In order to use an impulse dryer in the process according to the present invention, it is preferable that the shoe be designed to create sufficient adhesion between the web and the dryer to result in delamination upon creping.

Delamination is generally indicated by internal planarization of the fibers. Delamination can be determined using a freeze test. The freeze test is according to TAPPI UM-576 Method entitled, Beloit Sheet Splitter.

The variables that affect delamination include Yankee hood temperature, Yankee dryer temperature, creping adhesive composition, blade angle, moisture content of the web at the time of creping, chemistries used, stratification, fiber composition, basis weight, rate of heat transfer and time of drying.

Not wishing to be bound by theory, it is believed that the Yankee side of the web is sufficiently dry so as to act in the same manner as a completely dry web would during the creping operation. Since the other side of the web is significantly wetter, as the web is creped, a shear plane exists within the web resulting in delamination of the wetter part of the web from the dryer part of the web.

Creping is generally effected by scraping the web that has been fixed to a Yankee dryer with an adhesive/release agent from the Yankee by means of a creping blade. Any currently art recognized, or after developed creping blade may be used in the process according to the present invention. The creping blade, in one preferred embodiment may be the patented Taurus® blade, an undulatory creping blade, disclosed in U.S. Pat. No. 5,690,788, which is incorporated herein by reference in its entirety. This Taurus blade presents differentiated creping and rake angles to the sheet and having a multiplicity of spaced serrulated creping section of either uniform depths or non-uniform arrays of depths. The depths of the undulations are typically above about 0.008 inches and are further discussed herein.

Creping, by breaking a significant number of inter-fiber bonds, adds to and increases the perceived softness of resulting tissue or towel product.

The creping angle is preferably between about 60 and about 95 degrees, more preferably between about 65 and about 90 degrees, and most preferably between about 70 and about 85 degrees. Decreasing the blade bevel from about 15 degrees (creping angle 72 degrees) shows an increase in the breakup and delamination of the web which is reflected as an increase in void volume and clearer separation of the two delaminated layers. Unless handled correctly, the 0 degree blade caused actual disruptions of the top side layer of the sheet. Care must be taken to adjust the sheet take away angle from the creping pocket to insure that the line of the sheet draw be at or above the line of the creping blade surface. In this manner the sheet can be pulled out of the creping pocket before the nearly (or completely) delaminated sheets are damaged to the extent that they cannot be used for tissue or towel products.

Not wishing to be bound by theory, the process according to the present invention is believed to act in most respects exactly as the dry creping process acts. Thus, it is believed that the process according to the present invention may only be modified to improve runnability in a manner consistent with standard dry crepe protocols.

These dry crepe protocols include but are not limited to: creping angles, adhesive add-on rates, release add-on rates, sheet temperature (of the Yankee dryer side), blade changes, sheet threading, and crepe ratio (speed of the take-away relative to the creping cylinder). In short, the creping process is believed to behave quite similar to a dry crepe process and operators can use their existing understanding of these creping variables to adjust and control this process. The additional information the operator needs to know and control the temperature differentials across the sheet at the creping blade. These temperatures are indicative of the moisture differential across the sheet and therefore the propensity of the sheet to delaminate at creping. It could be particularly desirable to be able to change the creping pocket angle on the fly so as to have a direct means of controlling the downstream permeability of the sheet. In this manner, the subsequent drying of the sheet could be optimized for maximum production rates. For example, reduced air permeability will reduce TAD drying rates significantly. The operator could then close the creping pocket (reduce the creping angle) to regain this lost permeability. In this manner he would be able to maintain both productivity and sheet quality throughout the life of the creping blade. Or he could make grade changes without the need to break the sheet down at this critical creping step.

Drying of the web after creping is completed using any conventional drying form including, for example, through-air-drying (TAD), can drying or impulse drying. Transfer of the wet web to the after-dryer can be accomplished using any currently art recognized or after developed method for handling a wet web.

Figure 2:
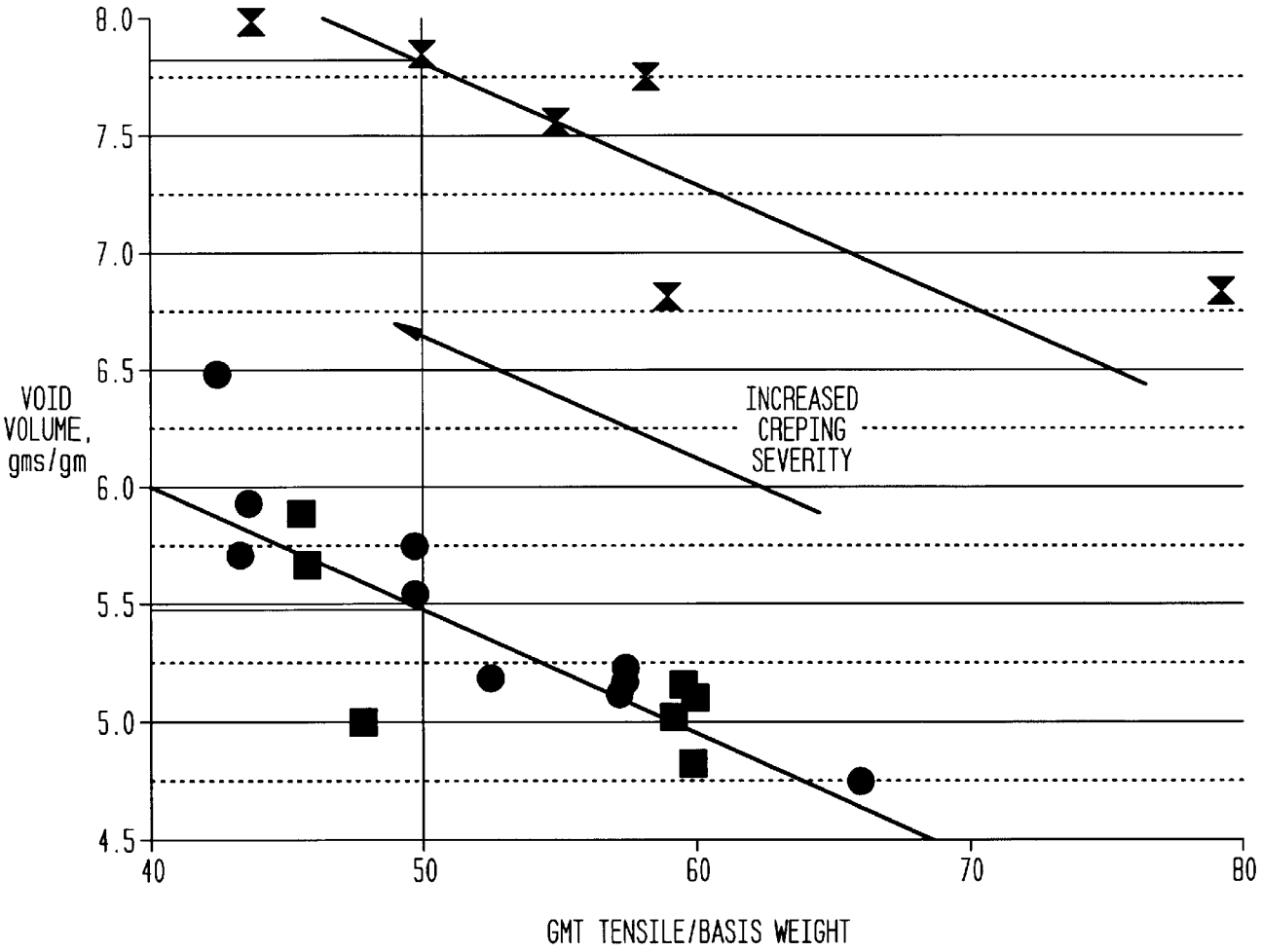
FIG. 2 is a graphical representation of the relationship between creping variables and void volume of the resulting web.
Figure 3:
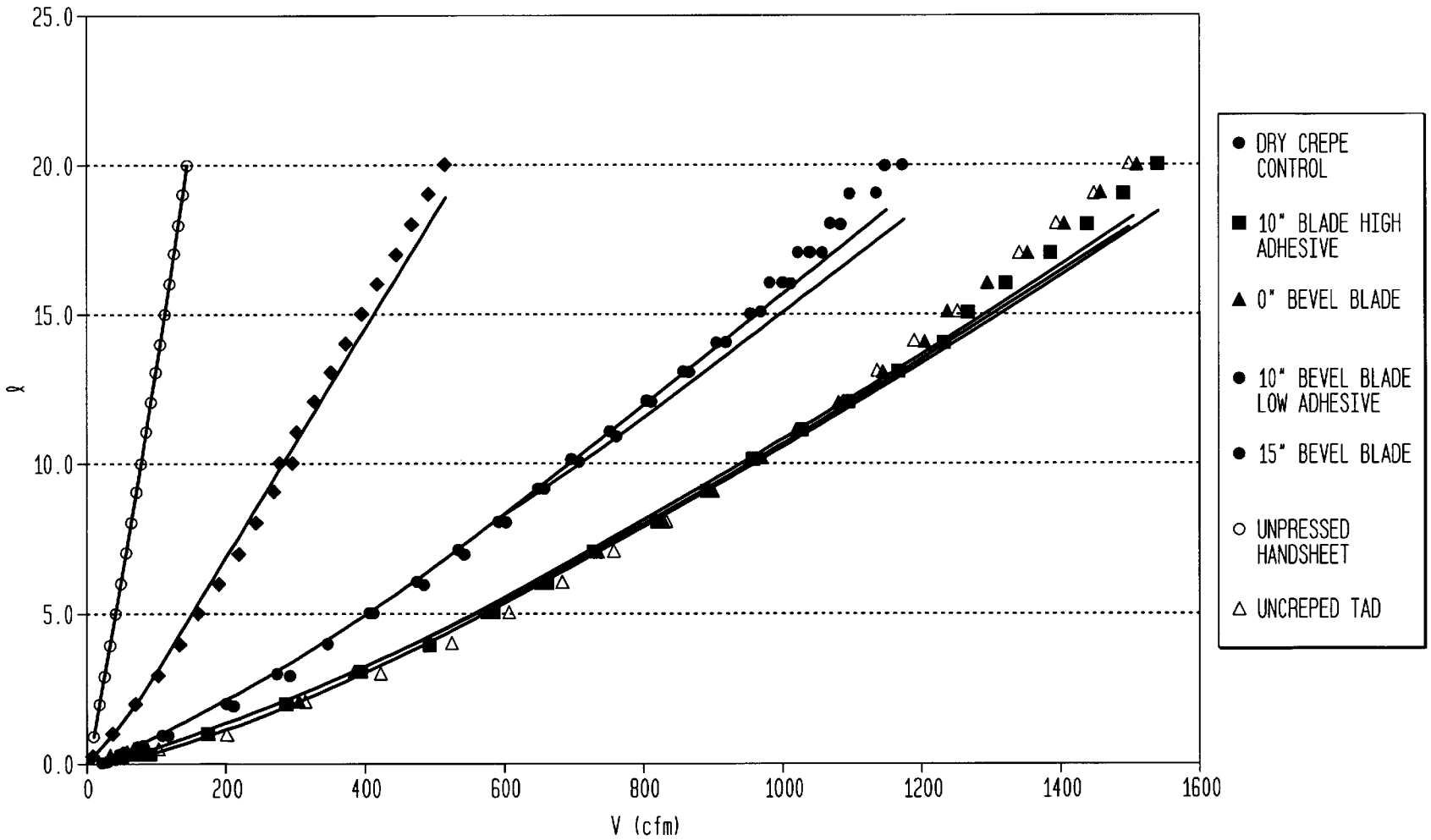
FIG. 3 is a graphical representation of the impact creping variables can have on web permeability of the resulting web.

FIG. 2 shows the response of the internal void volume of the web, as measure by the Porofil void volume test, to creping blade angle, or creping pocket. While in a delamination process useful in connection with the present invention, decreases in tensile strengths may be observed, the high void volume of the product according to the present invention allows these decreases to easily be offset by using pattern densification which is well understood from traditional TAD processes. FIG. 3 shows a similar response in the air permeability of the web. As can be seen from FIG. 3, the air permeability of the web according to the present invention is significantly above that which one of ordinary skill would expect for a similar dry creped product, which today is commonly used to predict the through air dryability of the web.

The web can be used to form single or multi-ply product benefiting from high internal volume or interruption of the pore structure in the interior of the sheet, including, for example, bathroom tissue, facial tissue, napkins, paper towels.

The following examples are illustrative of, but are not to be construed as limiting, the invention embodied herein.

EXAMPLES

Delamination Creping

Comparative Example A

A web was produced from a slurry of furnish mixture of 50% bleached southern hardwood draft (BHWK) and 50% bleached southern softwood kraft (BSWK). The furnish contained chemicals to assist with creping and felt/wire cleaning. The furnish was not refined. A nascent web was deposited on a pressing felt and pressed to a solids content of 44%, prior to being adhered to a Yankee dryer. The web was creped from the Yankee dryer at a solids content of less than 2% moisture using an 82° pocket angle and about 0.5 lbs/ton of creping adhesive and about 0.5 lbs/ton of release agent.

Example 2

A web was produced as described in Example 1 of the same fibers and furnish, except that the hoods were cooled down to reduce the dryness of the sheet at the creping blade. A nascent web was deposited on a pressing felt and pressed to a solids content of 44%, prior to being adhered to a Yankee dryer. The web was creped from the Yankee dryer at a solids content of 55% and a blade bevel of 15°. The web was subsequently pulled out using a pair of calender with rolls very lightly nipped with a resulting crepe of 15% left in the sheet. Percent crepe was calculated as:

$$\frac{\text{Yankee speed} - \text{Calender speed}}{\text{Yankee speed}}$$

The sheet was then collected and dried to a solids content of about 95% while held in restraint by sheet restraining/drying racks at room temperature. This restrained drying technique was used to determine a characteristic void volume which is set forth in Table 1. Multiple fabric can drying could also be used but might not exhibit such a dramatic effect in void volume, permeability, etc., due to the sheet compression during drying that is commonly encountered with this method.

Example 3

A web was produced as in Example 2, except that the creping was carried out using a 10° bevel blade.

Example 4

A web was produced as in Example 2, except that the creping was carried out using a 0° bevel blade.

The above examples establish that this process responds much like a normal dry creping process, but the low internal cohesion of the fibers in the web due to its wetness amplify the creping effects.

It was quite surprising that the coating on the Yankee surface never changed through out the above examples. Similar processes carried out on a cooler Yankee resulted in significant changes in the coating on the Yankee making the coating difficult to establish and to maintain.

In the process according to the present invention, the amount of wear observed on the creping blade was significantly reduced below that which one would expect from a wet crepe process. By way of illustrative example, crepe blades used in wet creping processes would often be worn out in as little as 30 minutes, while the creping blade in the process according to the present invention still showed almost no wear after 2 hours.

TABLE 1

Characteristic Wet-Crepe Properties

| Description | Basis Weight lbs/3000 $ft^2$ | Caliper Mills/1 Sheet | Absorbs $Gms/m^2$ | Void Volume, gms/gm | GM Tensile gms/inch | GM Modulus, gms/% str |
|---|---|---|---|---|---|---|
| Example 1 Conventional Dry Crepe | 29.0 | 9.95 | 145 | 5.25 | 561 | 88.1 |
| Example 2 Invention w/15° | 34.2 | 14.9 | 272 | 6.79 | 589 | 107.2 |
| Example 3 Invention w/10° Blade | 34.1 | 16.6 | 303 | 7.84 | 506 | 75.0 |
| Example 4 Invention w/0° Blade | 34.5 | 17.3 | 311 | 7.99 | 484 | 81.2 |
| Uncreped TAD Towel | 25.7 | 22.1 | 931 | — | 1026 | 41.9 |
| Conventional Wet Crepe Towel | 31.5 | 12.8 | 208 | 5.32 | 1118 | 114 |

The results show an increase in air permeability of about 2 to 4 times those of a conventionally dry creped web, in spite of the fact that the comparative wet creped samples were 20% heavier than the dry creped samples.

In some embodiments of the present invention, creping of the paper from the Yankee dryer is carried out using an undulatory creping blade, such as that disclosed in U.S. Pat. No. 5,690,788, noted above. Use of the undulatory crepe blade has been shown to impart several advantages when used in production of tissue products generally and especially when made primarily or entirely from recycled fibers. In general, tissue products creped using an undulatory blade have higher caliper (thickness), increased CD stretch, and a higher void volume than do comparable tissue products produced using conventional crepe blades. All of these changes effected by use of the undulatory blade tend to correlate with improved softness perception of the tissue products.

Another effect of using the undulatory blade is that there is a greater drop in sheet tensile strength during the creping operation than occurs when a standard creping blade is used. This drop in strength, which also improves product softness, is particularly beneficial when tissue base sheets having relatively high basis weights (>9 lbs/ream) or containing substantial amounts of recycled fiber are produced. Such products often have higher-than-desired strength levels, which negatively affect softness. In sheets including high levels of a recycled fiber, a reduction in strength equivalent to that caused by use of undulatory crepe blade can be effected, if at all, by application of extremely high levels of chemical debonders. These high debonder levels, in addition to increasing product cost, can also result in problems such as loss of adhesion between the sheet and the Yankee dryer, which adversely impacts sheet softness, runnability, felt filling, and formation of deposits in stock lines and chests. FIGS. 4A and 4B illustrate a portion of a preferred undulatory creping blade 60 of the patented undulatory blade usable in the practice of the present invention in which body 62 extends indefinitely in length, typically exceeding 100 inches in length and often reaching over 26 feet in length to correspond to the width of the Yankee dryer on the larger modem paper machines. Flexible blades of the patented undulatory blade having indefinite length can suitably be placed on a spool and used on machines employing a continuous creping system. In such cases the blade length would be several times the width of the Yankee dryer. In contrast, the width of the body 62 of the blade 60 is usually on the order of several inches while the thickness of the body 62 is usually on the order of fractions of an inch.

Figure 5:
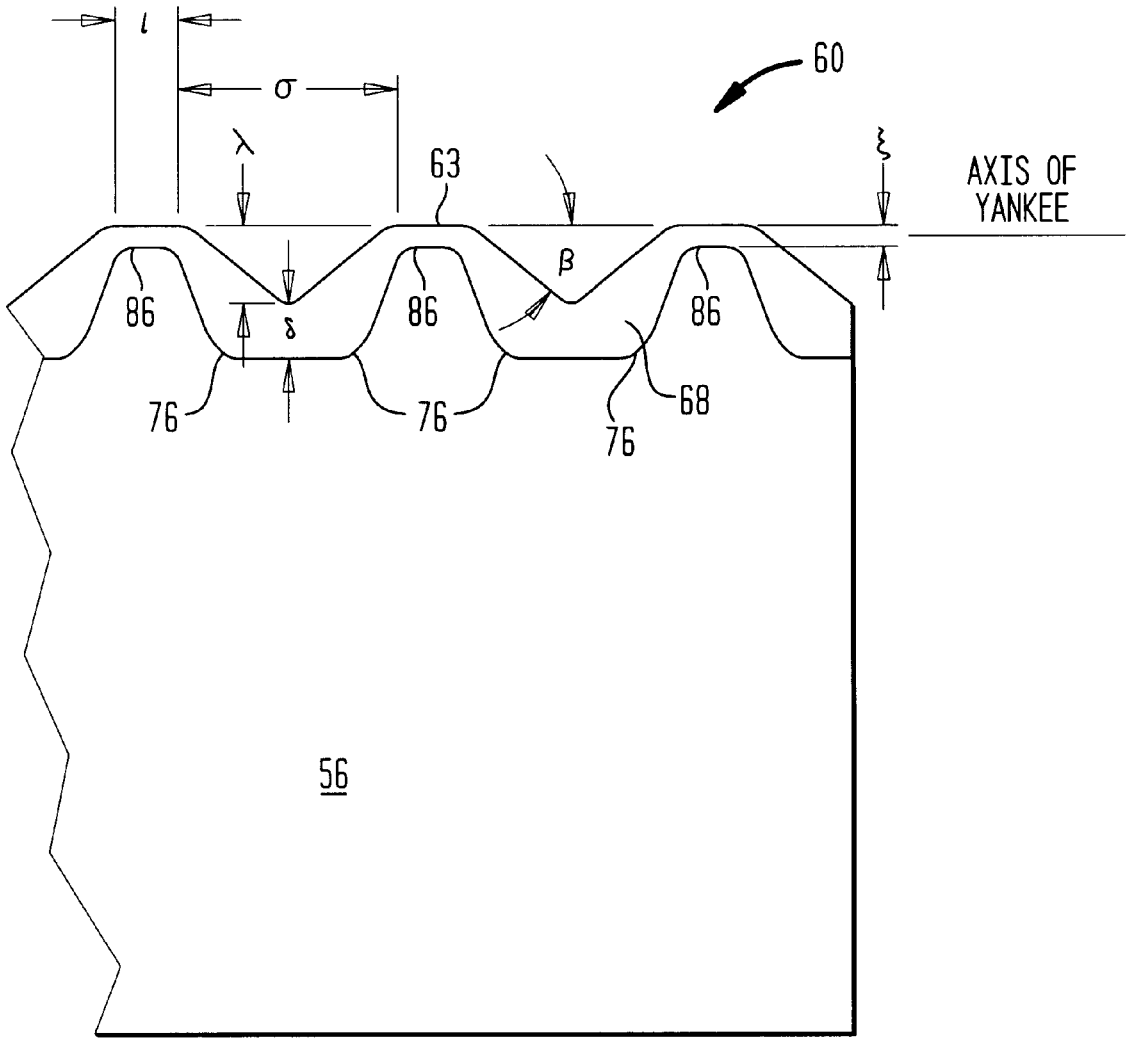
FIG. 5 schematically illustrates the contact region defined between a patented undulatory blade for use in the present invention and the Yankee.
Figure 7A:
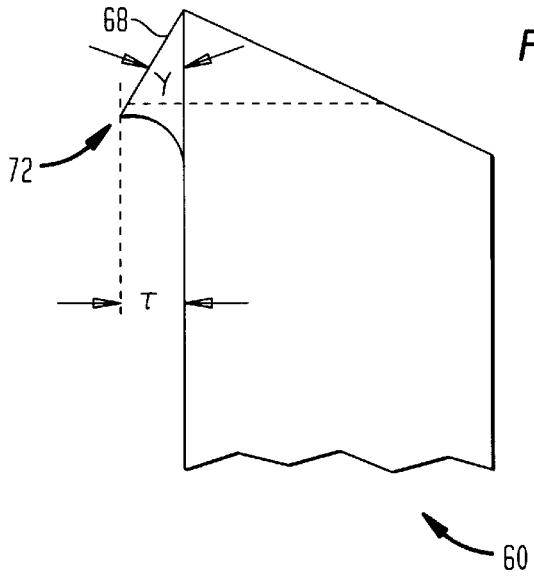
FIG. 7A illustrates an undulatory creping blade wherein the Yankee-side of the patented undulatory blade has been beveled at an angle equal to the that of the creping blade or holder angle.
Figure 7B:
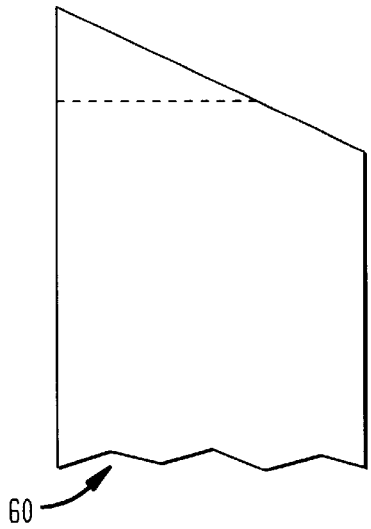
FIG. 7B illustrates a flush dressed undulatory creping blade for use in the present invention and the Yankee.
Figure 7C:
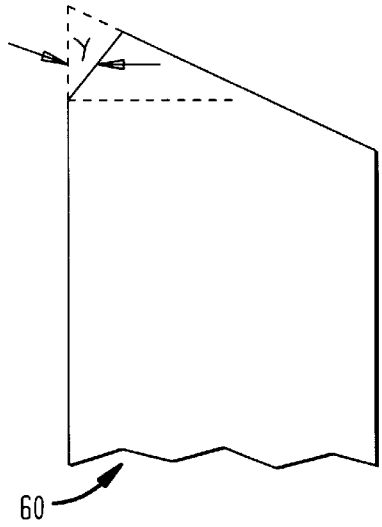
FIG. 7C illustrates a reversed relieved undulatory creping blade.
Figure 8:
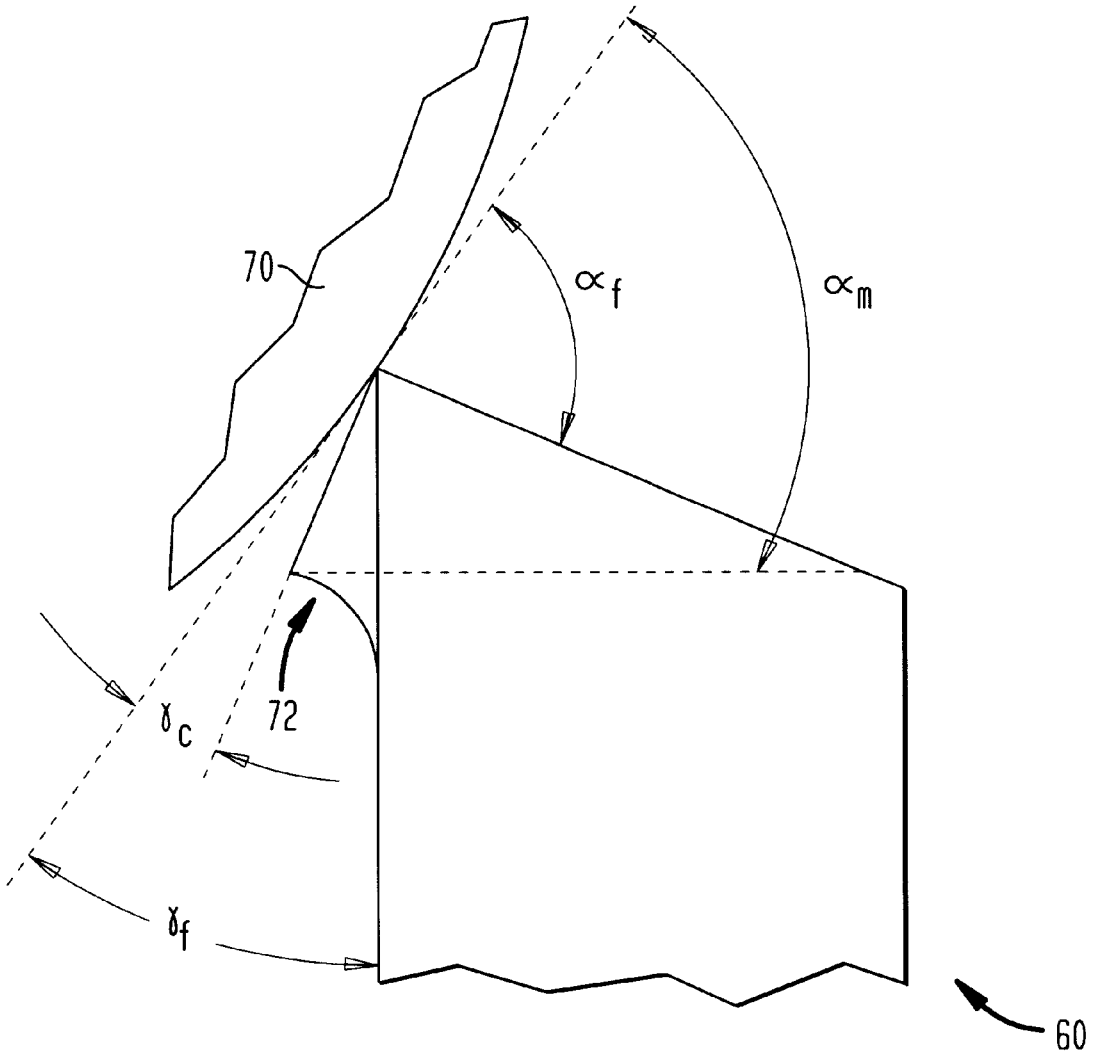
FIG. 8 shows the creping process geometry and illustrates the nomenclature used to define angles herein.

As illustrated in FIGS. 4A and 4B, an undulatory cutting edge 63 of the patented undulatory blade is defined by serrulations 66 disposed along, and formed in, one edge of the body 62 so that the undulatory engagement surface 68, schematically illustrated in more detail in FIGS. 5, 7 and 8, disposed between the rake surface 54 and the relief surface 56, engages the Yankee during use, as shown in FIG. 1, for example. Although a definitive explanation of the relative contribution of each aspect of the geometry is not yet available, it appears that four aspects of the geometry have predominant importance. In the most preferred blades 60 of the patented undulatory blade, four key distinctions are observable between these most preferred blades and conventional blades: the shape of the engagement surface 68, the shape of the relief surface 56, the shape of the rake surface 54, and the shape of the actual undulatory cutting edge 63. The geometry of engagement surface appears to be associated with increased stability as is the relief geometry. The shape of the undulatory cutting edge 63 of the patented undulatory blade appears to strongly influence the configuration of the creped web, while the shape of the rake surface 54 is thought to reinforce this influence.

It appears that improved stability of the creping operation is associated with presence of the combination of (i) the undulatory engagement surface 68 having increased engagement area; and (ii) the foot 72, as shown in FIG. 4C, defined in the relief surface 56 and providing a much higher degree of relief than is usually encountered in conventional creping. This is illustrated in FIGS. 7A, 7B and 7C. FIG. 7A illustrates a preferred blade of the patented undulatory blade, wherein, as shown in FIG. 8, the beveled area engages the surface of the Yankee 70 in surface-to-surface contact. In FIG. 7B, the foot 72 is dressed away so that the Yankee-side of the blade 60 is flat and the blade 60 engages the surface of the Yankee 70, as shown in FIG. 8, in line-to-surface contact. In FIG. 7C, not only has the Yankee-side foot 72 been removed but the Yankee-side of the blade 60 has been beveled at an angle equal to blade angle $\gamma_f$ as defined in FIG. 8. It appears that combinations of the four primary features greatly increase the beneficial results of use of the preferred undulatory blades 60 of the patented undulatory blade as used in the manufacture of absorbent paper products of this invention.

It is also hypothesized that hardening of the blade due to cold working during the knurling process may contribute to improved wear life. Microhardness of the steel at the root of a serrulation can show an increase of 3–5 points on the Rockwell "C" scale. This increase in believed to be insufficient to significantly increase the degree of wear experienced by the Yankee, but may increase blade life.

It appears that the biaxially undulatory geometry of the creped web is largely associated with presence of: (i) the undulatory rake surface 54, as shown in FIG. 4B; and (ii) the undulatory cutting edge 63, as shown in FIG. 4C, which both exert a shaping and bulking influence on the creped web.

Figure 6A:
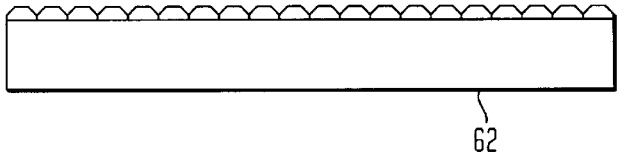
FIGS. 6A–G illustrate various elevational view of an undulatory creping blade for use in the present invention.
Figure 6B:
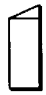
Figure 6C:
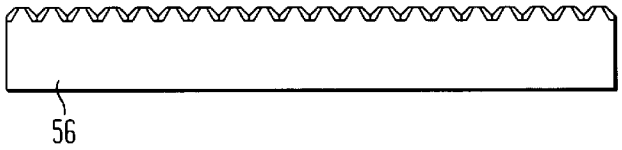
Figure 6D:
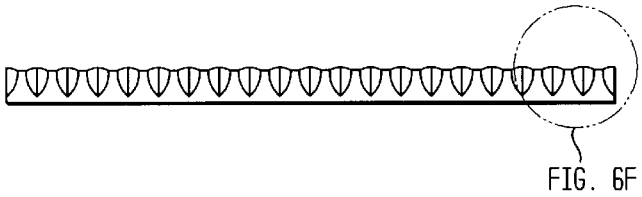
Figure 6E:
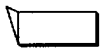
Figure 6F:
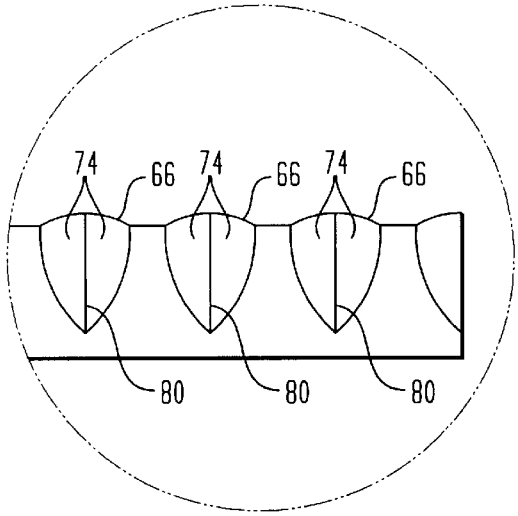
Figure 6G:
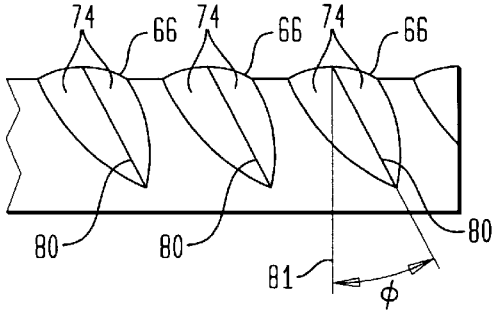

When the most preferred undulatory creping blades of the patented undulatory blade are formed as shown in FIGS. 4A, 4B, and 4C, and as shown in detail in FIGS. 5, 6F, and 6G, each serrulation 66 results in the formation of indented undulatory rake surfaces 74, nearly planar crescent-shaped bands 76, as shown in FIG. 5, foot 72, and protruding relief surface 79, as shown in FIG. 4C. In FIGS. 6F and 6G, each undulation is shown resulting in two indented undulatory rake surfaces 74 separated by a dividing surface 80. While the presence of the dividing surface 80 makes it easy to visualize the nature of the indented undulatory rake surface 74, there is no requirement that these surfaces be discontinuous. As illustrated best in FIG. 5, the undulatory engagement surface 68 consists of a plurality of substantially co-linear rectilinear elongate regions 86 of width $\epsilon$, and length "l" interconnected by nearly planar crescent-shaped bands of 76 of width $\delta$, depth $\lambda$, and span $\sigma$. As seen best in FIGS. 4B and 4C of the patented undulatory blade, each nearly planar crescent-shaped band 76 (shown in FIG. 5) defines one surface of each relieved foot 72 projecting out of the relief surface 56 of the body 62 of the blade 60. We have found that, for best results, certain of the dimensions of the respective elements defining the undulatory engagement surface 68, i.e., the substantially co-linear rectilinear elongate regions 86 and the nearly planar crescent-shaped bands 76, both shown in FIG. 7 are preferred. In particular, as shown in FIG. 7, the width $\epsilon$ of the substantially co-linear rectilinear elongate regions 86 is preferably substantially less than the width $\delta$ of the nearly planar crescent-shaped bands 76, at least in a new blade. In preferred embodiments of the patented undulatory blade used to manufacture the absorbent paper products of this invention, the length "l" of the substantially co-linear rectilinear elongate regions 86 should be from about 0.002" to about 0.084". For most applications, "l" will be less than 0.05". The depth $\lambda$ of the serrulations 66 in the patented undulatory blade should be from about 0.008" to about 0.050"; more preferably from about 0.010" to about 0.035" and most preferably from about 0.015" to about 0.030", and the span $\sigma$ of the nearly planar crescent-shaped bands 76 should be from about 0.01" to about 0.095"; more preferably from about 0.02" to about 0.08" and most preferably from about 0.03" to about 0.06". Blades having a discontinuous undulatory engagement surface 68 can also be used. This can happen if the blade 60 is tilted in one of two ways: first, the undulatory engagement surface may consist only of substantially co-linear elongate regions 86 or possibly a combination of substantially co-linear elongate regions 86 and the upper portions of crescent-shaped bands 76 if blade 60 is tilted away from the Yankee 70; or second, the undulatory engagement surface may consist of the lower portions of the crescent-shaped bands 76 if the blade 60 is tilted inwardly with respect to the Yankee 70. Both of these configurations do run stably and, in fact, have run satisfactorily for extended periods.

Several angles are defined in order to describe the geometry of the cutting edge of the undulatory blade of the patented undulatory blade used in the manufacture of the absorbent paper of this invention. To that end, we prefer to use the following terms:

Creping angle "$\alpha$"—the angle between the rake surface 54 of the blade 60 and the plane tangent to the Yankee 70 at the point of intersection between the undulatory cutting edge 63 and the Yankee 70;

Axial rake angle "$\beta$"—the angle between the axis of the Yankee 70 and the undulatory cutting edge 63 which is, of course, the curve defined by the intersection of the surface of the Yankee 70 with indented rake surface 74 of the blade 60;

Relief angle "$\gamma$"—the angle between the relief surface 56 of the blade 60 and the plane tangent to the Yankee 70 at the intersection between the Yankee 70 and the undulatory cutting edge 63, the relief angle measured along the flat portions of the present blade is equal to what is commonly called "blade angle" or holder angle"; and Side rake angle "$\phi$", shown in FIG. 8—the angle between the line 80 and the normal to the Yankee 70 in the plane defined by the normal to the Yankee at the points of contact in with the cutting edge of the blade (FIGS. 41 and 6A–F) and the axis of the Yankee dryer 81. The Yankee 70 is shown in FIG. 8.

Quite obviously, the value of each of these angles will vary depending upon the precise location along the cutting edge at which it is to be determined. We believe that the remarkable results achieved with the undulatory blades of the patented undulatory blade in the manufacture of the absorbent paper products of this invention are due to those variations in these angles along the cutting edge. Accordingly, in many cases it will be convenient to denote the location at which each of these angles is determined by a subscript attached to the basic symbol for that angle. We prefer to use the subscripts "f", "c" and "m" to indicate angles measured at the rectilinear elongate regions, at the crescent shaped regions, and the minima of the cutting edge, respectively. Accordingly, "$\gamma_f$", the relief angle measured along the flat portions of the present blade, is equal to what is commonly called "blade angle" or "holder angle".

Figure 9A:
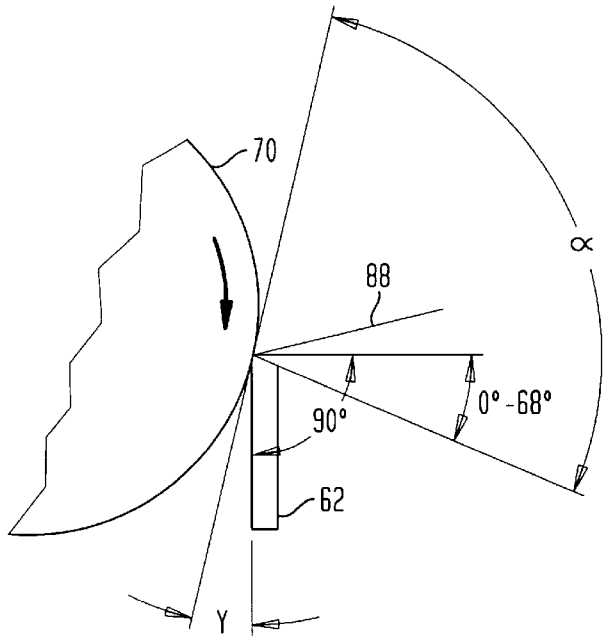
FIGS. 9A and 9B contrast the creping geometry of the patented undulatory blade with that of the blade disclosed in Fuerst, U.S. Pat. No. 3,507,745.
Figure 9B:
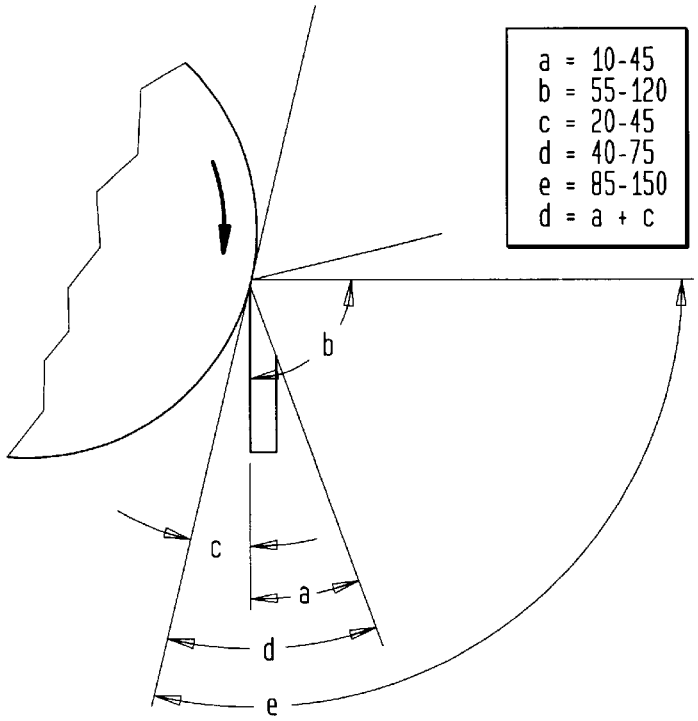

For example, as illustrated in FIGS. 8 and 9A–B, the local creping angle "$\alpha$" of the patented undulatory blade is defined at each location along the undulatory cutting edge 63 as being the angle between the rake surface 54 of the blade 60 and the plane tangent to the Yankee 70. Accordingly, it can be appreciated that as shown in FIGS. 8 and 9A–B, "$\alpha_f$", the local creping angle adjacent to the substantially co-linear rectilinear elongate regions 86 (shown in FIG. 7) is usually higher than "$\alpha_c$", the local creping angle adjacent to the nearly planar crescent-shaped bands 76. Further, it can be appreciated that, as shown in FIGS. 5, 6A–F, and 8 along the length of the nearly planar crescent-shaped bands 76, the local creping angle "$\alpha_c$" varies from higher values adjacent to each rectilinear elongate region 86 to lower values "$\alpha_m$" adjacent the lowest portion of each serrulation 66. Angle "$\alpha_c$", though not specifically labeled in FIG. 8 should be understood to be the creping angle measured at any point on the indented undulatory rake surface 74 (shown in FIGS. 6A–G). As such, it will have a value between "$\alpha_f$" and "$\alpha_m$". In preferred blades of the patented undulatory blade, the rake surface may generally be inclined, forming an included angle between 30° and 90° with respect to the relief surface, while "$\alpha_f$" will range from about 30° to about 135°, preferably from about 60° to about 135°, and more preferably from about 75° to about 125° and most preferably 85° to 115°; while "$\alpha_m$" will preferably range from about 15° to about 135°, and more preferably from about 25° to about 115°.

Similarly, as illustrated in FIG. 5, the local axial rake angle "β" is defined at each location along the undulatory cutting edge 63. The angle is formed between the axis of the Yankee 70 and the curve defined by the intersection of the surface of the Yankee 70 with the indented rake surface 74 of the blade 60, otherwise known as undulatory cutting edge 63. Accordingly, it can be appreciated that the local axial rake angle along the substantially co-linear rectilinear elongate regions 86, "$\beta_f$", is substantially 0°, while the local axial rake angle along the nearly planar crescent-shaped bands 76, "$\beta_c$", varies from positive to negative along the length of each serrulation 66. Further, it can be appreciated that the absolute value of the local axial rake angle "$\beta_c$" varies from relatively high values adjacent to each rectilinear elongate region 86 to much lower values, approximately 0°, in the lowest portions of each serrulation 66. In preferred blades of the patented undulatory blade, "$\beta_c$" will range in absolute value from about 15° to about 75°, more preferably from about 20° to about 60°, and most preferably from about 25° to about 45°.

As discussed above and shown best in FIGS. 4A, 4B, and 4C, in the preferred blades of the patented undulatory blade for manufacture of the absorbent paper products of the present invention, each nearly planar crescent-shaped band 76 (shown in FIG. 5) intersects a protruding relief surface 79 of each relieved foot 72 projecting out of the relief surface 56 of the body 62 of the blade 60. While we have been able to operate the process of the patented undulatory blade with blades 60 not having a relieved foot 72, we have found that the presence of a substantial relief foot 72 makes the procedure much less temperamental and much more forgiving. We have found that for very light or weak sheets, the process often does not run easily without the foot. FIGS. 7A, 7B, and 7C illustrate the blade 60 with and without a foot 72. Normally, we prefer that the height "τ" of each relieved foot 72 be at least about 0.005" at the beginning of each operation. It appears that most stable creping continues for at least the time in which the relieved foot 72 has a height "τ" of at least about 0.002" and that, once the relieved foot 72 is entirely eroded, the web becomes much more susceptible to tearing and perforations.

As illustrated in FIGS. 8 and 9A–B, the local relief angle "γ" is defined at each location along the undulatory cutting edge 63 as being the angle between the relief surface 56 of the blade 60 and the plane tangent to the Yankee 70.

Accordingly, it can be appreciated that "$\gamma_f$", the local relief angle having its apex at surface 63, is greater than or equal to "$\gamma_c$", the local relief angle adjacent to the nearly planar crescent-shaped bands 76. Further, it can be appreciated that the local relief angle "$\gamma_c$" varies from relatively high values adjacent to each rectilinear elongate region 86 to lower values close to 0° in the lowest portions of each serrulation 66. In preferred blades of the patented undulatory blade, "$\gamma_f$" will range from about 5° to about 60°, preferably from about 10° to about 45°, and more preferably from about 15° to about 30°, these values being substantially similar to those commonly used as "blade angle" or "holder angle" in conventional creping; while "$\gamma_c$" will be less than or equal to "$\gamma_f$", preferably less than 10° and more preferably approximately 0° if measured precisely at the undulatory cutting edge 63. However, even though the relief angle "$\gamma_c$" when measured precisely at undulatory cutting edge 63 is very small, it should be noted that relief surface 56, which is quite highly relieved, is spaced only slightly away from undulatory cutting edge 63.

In most cases, side rake angle "φ", defined above, is between about 0° and 45° and is "balanced" by another surface of mirror image configuration defining another opposing indented rake surface 74 as we normally prefer that the axis of symmetry of the serrulation be substantially normal to the relief surface 56 of the blade 60 as is shown in FIG. 6F. However, we have obtained desirable results when the serrulations are not "balanced" but rather are "skewed" as indicated in FIG. 6G. The undulatory creping blade 60 of the patented undulatory blade used in the manufacture of the absorbent paper products of this invention comprises an elongated, relatively rigid, thin plate, the length of the plate being substantially greater than the width of the plate and the width of the plate being substantially greater than the thickness thereof, the plate having: an undulatory engagement surface formed therein along the length of an elongated edge thereof, the undulatory engagement surface being adaptable to be engaged against the surface of a Yankee drying cylinder, the undulatory engagement surface constituting a spaced plurality of nearly planar crescent-shaped bands of width "δ", depth "λ" and span "σ" interspersed with, and inter-connected by, a plurality of substantially co-linear rectilinear elongate regions of width "ε" and length "ι", the initial width "ε" of the substantially rectilinear elongate regions being, substantially less than the initial width "δ" of the nearly planar crescent-shaped band of the serrulated engagement surface.

In the undulatory creping blade, the creping angle, defined by the portion of each indented rake surface interspersed among the substantially co-linear rectilinear elongate regions, is between about 30° and 135°, the absolute value of the side rake angle "φ" being between about 0° and 45°.

In a preferred embodiment of the patented undulatory blade, the undulatory creping blade comprises an elongated, relatively rigid, thin plate, the length of the plate being substantially greater than the width of the plate and typically over 100 inches in length and the width of the plate being substantially greater than the thickness thereof, the plate having: a serrulated engagement surface formed therein along the length of an elongated edge thereof, the serrulated engagement surface being adaptable to be engaged against the surface of a Yankee drying cylinder, the serrulated engagement surface constituting a spaced plurality of nearly planar crescent-shaped bands of width "δ", depth "λ" and span "σ" interspersed with, and inter-connected by a plurality of substantially co-linear rectilinear elongate regions of width "ε" and length "ι", the initial width "ε" of the substantially rectilinear elongate regions being substantially less than the initial width "ε" of the nearly planar crescent-shaped bands of the serrulated engagement surface, a rake surface defined thereupon adjoining the serrulated engagement surface, extending across the thickness of the plate. A relief surface defined there upon adjoining the serrulated engagement surface, the length "ι" of each of the plurality of substantially co-linear rectilinear elongate regions being between about 0.0020" and 0.084", the span "σ" of each of said plurality of nearly planar crescent-shaped bands being between about 0.01" and 0.095", the depth "λ" of each of the plurality of nearly planar crescent-shaped bands being between about 0.008" and 0.05".

Advantageously, adjacent each of the relieved nearly planar crescent-shaped bands, a foot having a height of at least about 0.001" protrudes from the relief surface, the relief angle of the relieved nearly planar crescent-shaped bands being greater than the relief angle of substantially co-linear rectilinear elongate regions.

Figure 10:
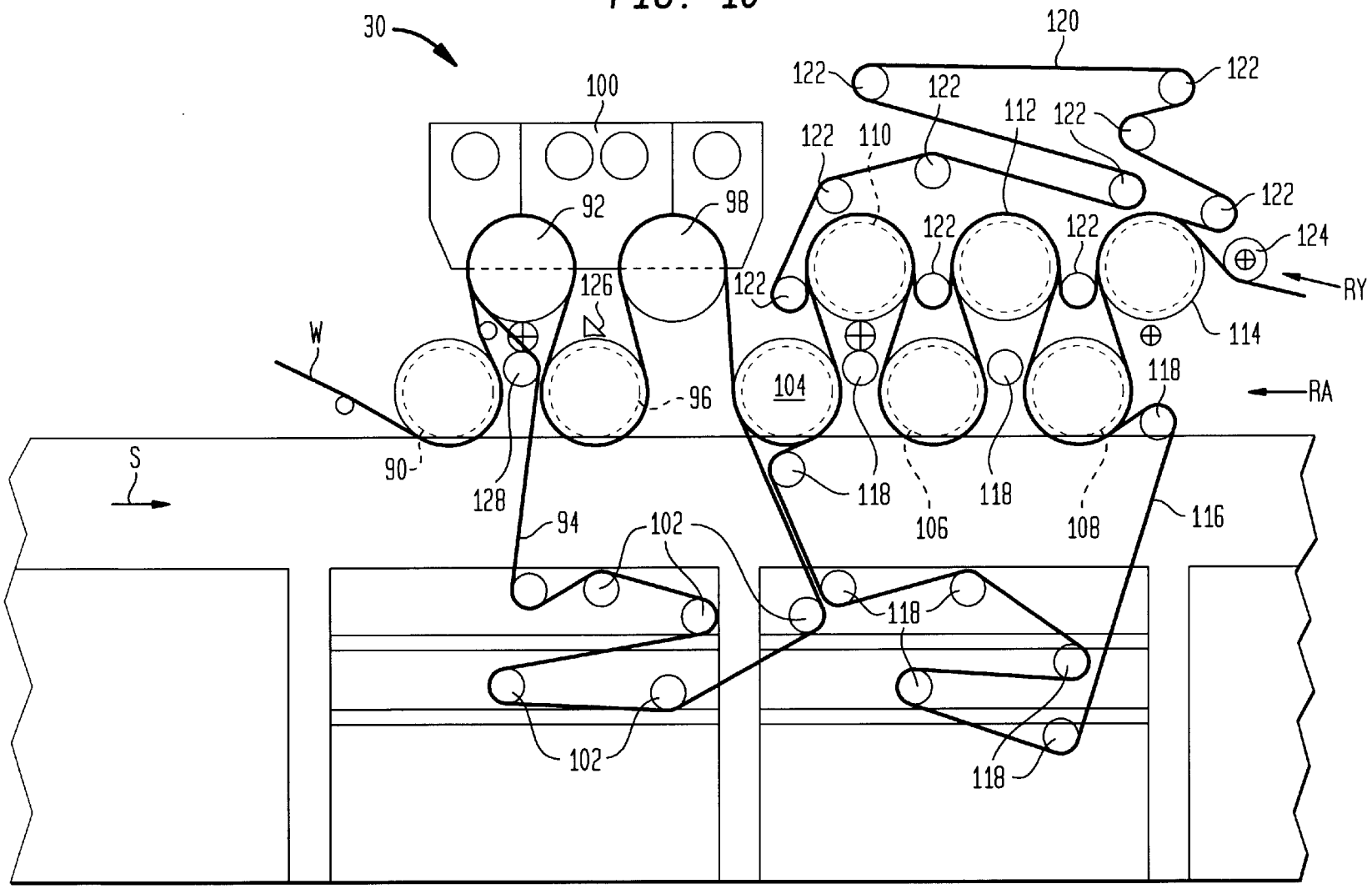
FIG. 10 is a schematic illustration of an exemplifying embodiment of an after-crepe drying section of the invention in which there is a dryer group that makes use of single-wire draw in the beginning of the after-dryer, in which reversing rolls/cylinders are provided with an impingement drying device, and a dryer group with twin-wire draw arranged after the group with single-wire draw.

After the web W is creped from the Yankee dryer 26 of FIG. 1 it is transferred to an after-crepe drying section 30 as shown in FIG. 10. This machinery is described in detail in U.S. Pat. No. 5,968,590 of Ahonen et al., the disclosure of which is hereby incorporated by reference in its entirety. The '590 patent is not directed to absorbent creped products; however, the impingement air dryers described are utilized in a wet crepe process as detailed below in connection with FIGS. 10 through 13.

Referring to FIG. 10, after creping, the web W is passed in a direction S into an after-dryer onto a first drying cylinder 90 placed in a lower row RA, over which the web W is passed into an inverted dryer group with single-wire draw of the after-dryer, and more specifically onto its first reversing roll/cylinder 92 in an upper row RY. From the first reversing roll/cylinder 92, the web W is passed by means of a drying wire or an equivalent support fabric 94 onto a drying cylinder 96 in the lower row RA and further onto a reversing roll or cylinder 98 in the upper row RY. In connection with the reversing rolls or cylinders 92,98 in the upper row RY, an impingement blowing apparatus 100 is arranged such that drying means (gas/air jets) are blown toward the web W. The guide rolls of the drying wire 94 are denoted by reference numeral 102, and by means of a guide roll 128, the run of the drying wire 94 is shifted so that it does not contact the web W to be dried that runs over the drying cylinder 90.

From the reversing roll/cylinder 98, the web W is passed as a closed draw supported by the drying wire 94 into a dryer group with twin-wire draw onto a first drying cylinder 104 in its lower row RA of drying cylinders. In FIG. 10, the drying cylinders in the lower row RA are denoted by reference numerals 104, 106 and 108, and the web W runs alternating and meandering over these drying cylinders 104,106,108 onto drying cylinders 110, 112 and 114 in the upper row RY. A drying wire 116 of the lower-row RA cylinders 104,106,108 runs guided by guide rolls 118, and a drying wire 120 of the upper row RY runs guided by guide rolls 122. The web W is passed over a guide roll/alignment roll 124 to further processing. In connection with the drying cylinders, a doctor 126 can be provided.

As the reversing rolls/cylinders, particularly preferred are suction cylinders marketed by Valmet Corporation (Helsinki) under the trademark VAC-ROLL® and provided without an interior suction box, reference being made, with respect to the details of the constructions of such rolls, to Finnish Pat. No. 83,680 (corresponding to U.S. Pat. Nos. 5,022,163 and 5,172,491 incorporated by reference herein). Instead of the Vac-Roll suction cylinders, it is also possible to use rolls marketed by Valmet under the trademark UNO® or cold or hot cylinders in themselves known. The vacuum applied to the rolls is for purposes of orderly processing of the web. The drying impingement air is supplied by way of impingement device 100 having the characteristics described in connection with FIGS. 11A and 11B. It should be noted from the discussion which follows that the drying process is not a through-dry process, rather the air is supplied and collected by impingement device 100.

Figure 11A:
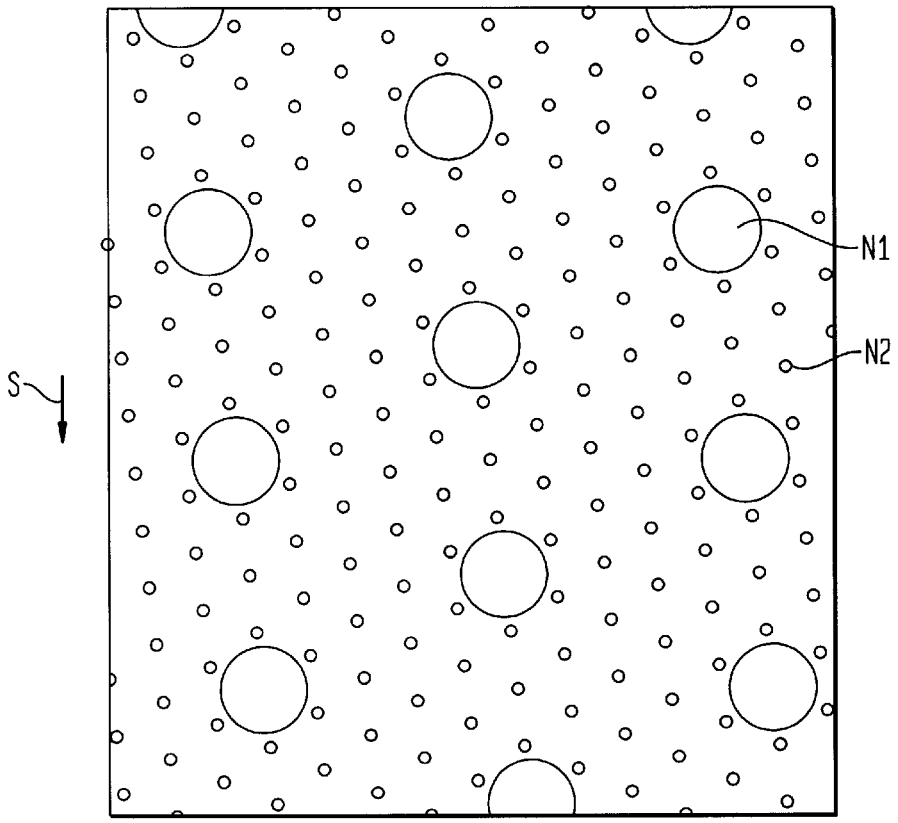
FIGS. 11A and 11B are schematic illustrations of an exemplifying embodiment of the nozzle face of an impingement drying device for use in accordance with the invention.
Figure 11B:
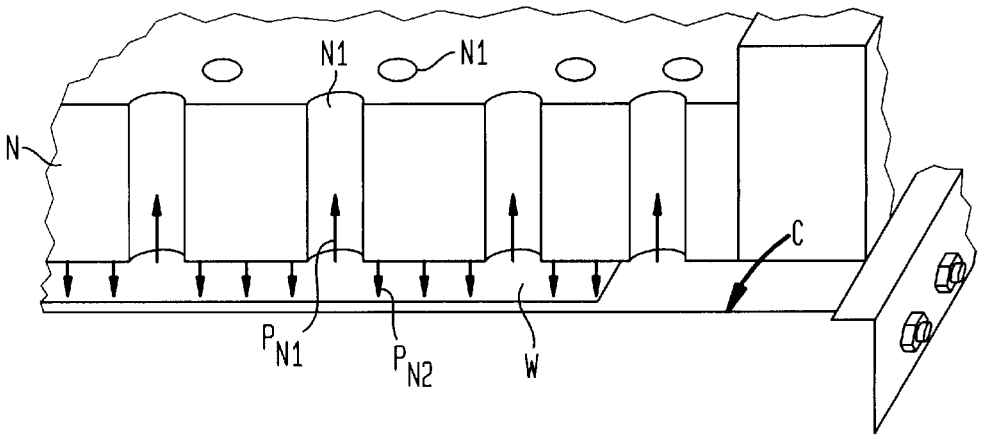

FIGS. 11A and 11B are schematic illustrations of the construction of the nozzle face of the impingement drying device 100 utilized in any of the embodiments in accordance with the invention described herein. In the impingement blowing device, blow holes are denoted by reference N2 and direct an air flow $P_{N2}$ toward the web and exhaust air pipes are denoted by reference N1 and remove an air flow $P_{N1}$ from the vicinity of the web. The diameter of each exhaust air pipe N1 is about 50 mm to about 100 mm, preferably about 75 mm, and the diameter of each blow hole is about 3 mm to about 8 mm, most commonly about 5 mm. The paper web W runs at a distance of about 10 mm to about 150 mm, preferably about 25 mm, from the face of the nozzle plate, and the nozzle chamber of the hood is denoted by reference letter N. The cylinder face against which the impingement-drying device is arranged is denoted by reference C. The open area of the blow holes in the nozzle plate in the area of the web W is about 1% to about 5% and most commonly about 1.5%. The velocity of air in the blow holes is about 40 meters per second to about 150 meters per second, preferably about 100 m.p.s. The air quantity that is blown is about 0.5 to about 2.5 cu.m per second per sq.m, which is calculated for the effective area of the hood. Most commonly an air quantity of about 1 to 1.5 cu.m per second per sq.m is used. The open area of the exhaust air pipes is about 5% to about 15%, most commonly about 10%. In addition to the nozzle face illustrated in FIG. 11A, it is possible to use a commonly known slot nozzle construction, fluid nozzle construction, foil nozzle construction, or a direct-blow nozzle construction as well as, for example, infra dryers, as well as any of those mentioned above alternatingly in the cross direction of the machine as what are called combination dryers.

The impingement drying equipment to be used in connection with the exemplifying embodiments illustrated above in FIGS. 1–10 can be an arrangement of a number of different types and in itself known to a person skilled in the art, in which arrangement drying air flows are blown toward the web to be dried. The impingement drying equipment can be constructed in blocks in the running direction S of the web or in the direction transverse to the running direction, in which case, each block can be regulated separately, if necessary or desired.

Figure 12:
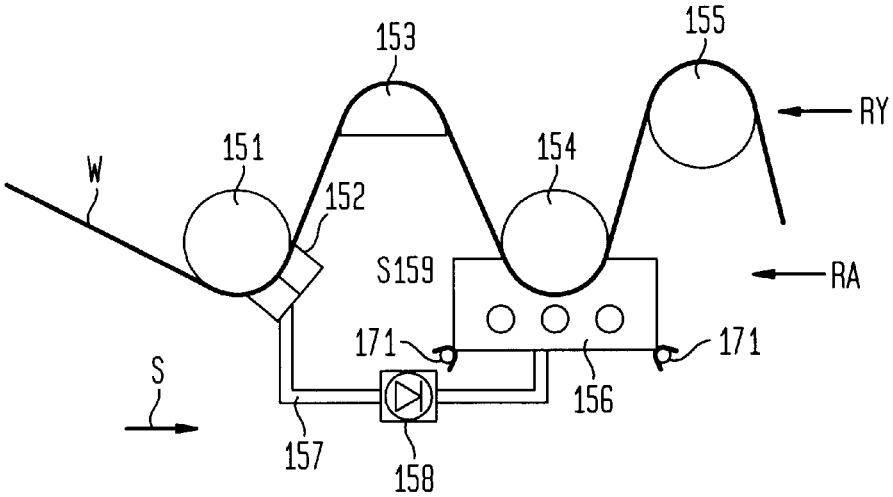
FIG. 12 is a schematic illustration of an exemplifying embodiment of the invention in which an infra dryer is arranged in the beginning of the after-dryer connected with the first cylinder and whose heat is used in connection with impingement drying, and a reversing blow device is arranged between the infra and the impingement dryer.

In the exemplifying embodiment shown in FIG. 12, after creping, the paper web W is passed onto a drying cylinder 151, in whose connection an infra drying (IR) equipment 152 is arranged. After this, the paper web to be dried is passed over a reversing blow box 153 onto a drying cylinder 154 and further onto a reversing roll or a drying cylinder or equivalent 155. In connection with the cylinder/roll 154, an impingement drying equipment 156 is arranged which can be opened for cleaning. The wire draw takes place as a normal single-wire draw as described above in relation to some of the preceding illustrated embodiments. The hot exhaust air of the infra dryer 152 is passed along a duct 157 through a blower 158 for use in the impingement dryer 156. This infra-heated air can be used directly as impingement blow air, for example, to replace air that would have to be heated otherwise, or as pre-heated air in the burner in which this blow air for the impingement dryer is heated, or as replacement air for the impingement dryer. The impingement drying equipment 156 can be openable towards the bottom by means of pivot members 171.

Figure 13:
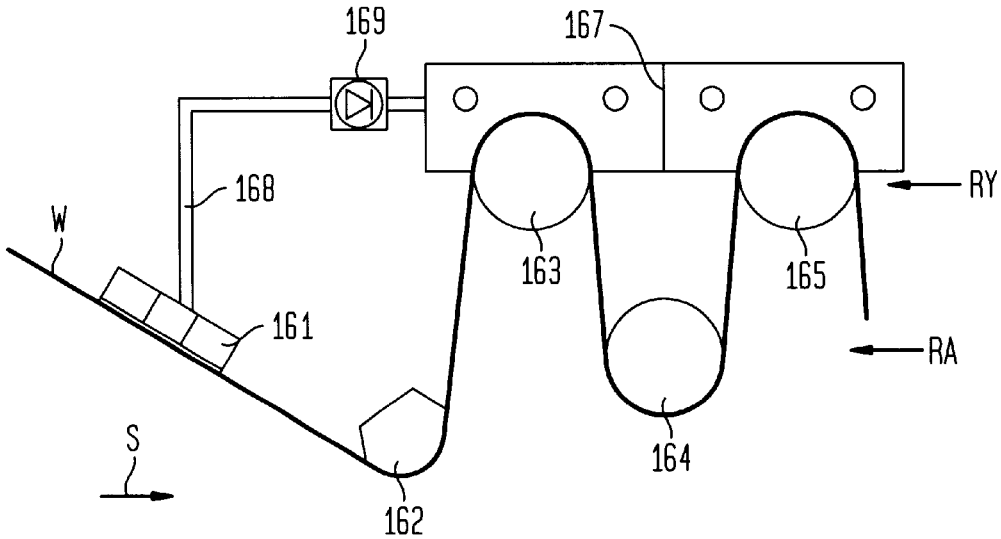
FIG. 13 is a schematic illustration of an exemplifying embodiment of the invention in which the web is dried by means of an infra dryer or a gas dryer after the coating whose heat is utilized in impingement drying, and in which a reversing blow box is arranged after the infra dryer which is followed by an impingement dryer group.

The exemplifying embodiment shown in FIG. 13 represents an arrangement in which the web W is dried first by means of an infra/gas dryer 161, after which the run of the web W is turned by means of a reversing blow box 162 and the web W is passed to run into a group of cylinders 163–165 provided with an inverted single-wire draw. In connection with the reversing rolls/cylinders 163,165 in the inverted group with single-wire draw, impingement drying devices 167 are provided. The exhaust air from the infra/gas dryer 161 is used as drying air for the impingement drying, and the exhaust gas is passed through the ducts 168 and through the blower 169 into the air system of the impingement drying.

Figure 14:
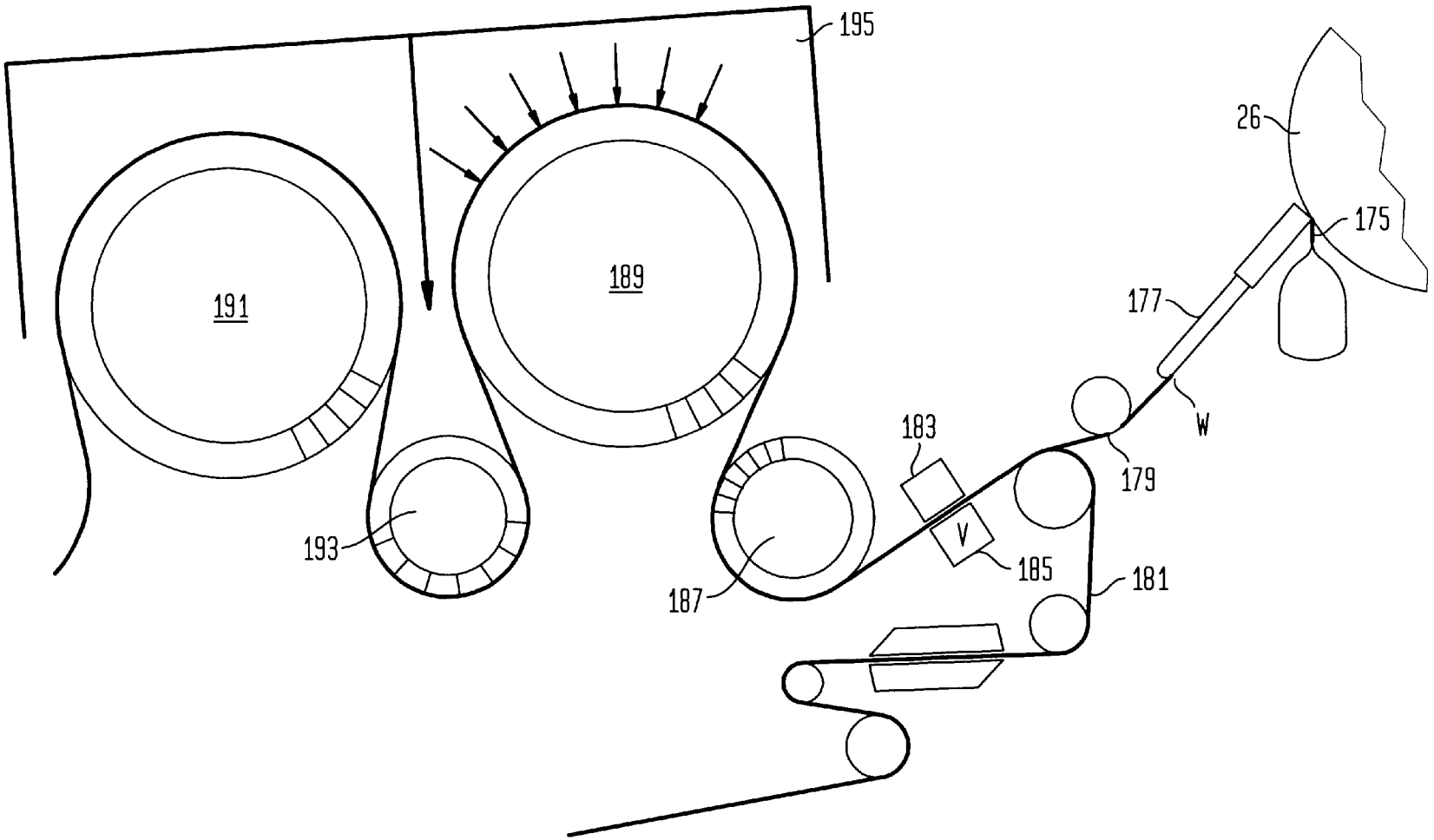
FIG. 14 is an illustration of yet another wet crepe, impingement air after dry apparatus constructed in accordance with the present invention.

There is shown in FIG. 14 still yet another wet crepe/impingement-air dry apparatus useful in connection with the present invention. The web is creped off of a Yankee dryer, such as Yankee dryer 26 of FIG. 1 utilizing a creping blade 175. The web W is aerodynamically stabilized over an open draw utilizing an air foil 177 as generally described in U.S. Pat. No. 5,891,309 to Page et al., the disclosure of which is incorporated herein by reference. Following a transfer roll 179, web W is disposed on a transfer fabric 181 and subjected to wet shaping by way of an optional blow box 183 and vacuum shoe 185. The particular conditions and impression fabric selected depend on the product desired and may include conditions and fabrics described above or those described or shown in one or more of: U.S. Pat. No. 5,510,002 to Hermans et al.; U.S. Pat. No. 4,529,480 of Trokhan; U.S. Pat. No. 4,1021,737 of Morton and U.S. Pat. No. 3,994,771 to Morgan, Jr. et al., the disclosures of which are hereby incorporated by reference into this section.

After wet shaping, web W is transferred over vacuum roll 187 to an impingement air-dry device as described above in connection with FIGS. 10, 11A and 11B. The apparatus of FIG. 14 generally includes a pair of drilled hollow cylinders 189, 191, a vacuum roll 193 therebetween as well as a hood 195 equipped with nozzles and air returns as discussed in connection with FIGS. 11A and 11B.

Figure 15:
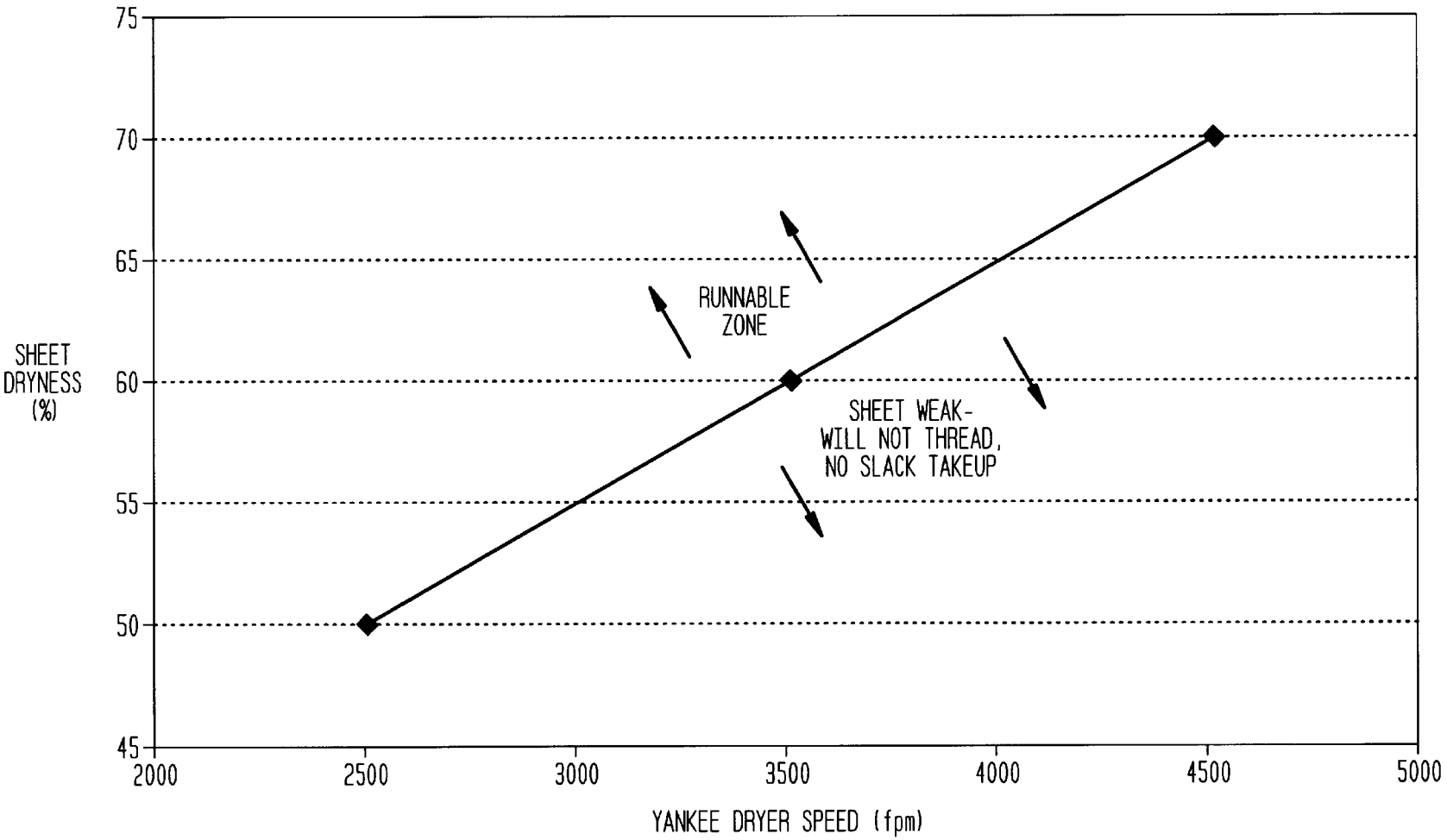
FIG. 15 illustrates the relationship of sheet dryness to stable transfer over an open draw following creping off of a Yankee dryer.

In connection with FIG. 14, it should be noted that transfer of a web W over an open draw needs to be stabilized at high speeds. In this connection there is shown in FIG. 15 a relationship between sheet speed off of a Yankee dryer and moisture content for stable web transfer. Running a wet crepe process to the upper left of the diagram requires stabilization, preferably with a contoured or other air foil.

While the invention has been described in detail in various embodiments, modifications within the spirit and scope of the present invention, set forth in the appended claims, will be apparent to those of skill in the art. The foregoing description and exemplification in no way limits the scope of the present invention which is defined in the following claims.

What is claimed is:

1. A method of making absorbent sheet from cellulosic fiber comprising the steps of:

(a) depositing an aqueous cellulosic furnish on a foraminous support;

(b) dewatering said furnish to form a cellulosic web;

(c) applying said dewatered web to a heated rotating cylinder and drying said web to a consistency of greater than about 40 percent and less than about 80 percent;

(d) creping said web from said heated cylinder at said consistency of greater than about 40 percent and less than about 80 percent, and optionally wet shaping said web wherein said web is rendered suitable for impingement-air drying; and (e) drying said web with an impinging heated gaseous medium subsequent to creping said web from said heated cylinder to form said absorbent sheet.

2. The method according to claim 1, wherein said web is dewatered to a consistency of at least about 30 percent prior to being applied to said heated cylinder.

3. The method according to claim 2, wherein said web is dewatered to a consistency of at least about 40 percent prior to being applied to said heated cylinder.

4. The method according to claim 1, wherein said web is dried to a consistency of at least about 50 percent on said heated cylinder prior to being creped.

5. The method according to claim 4, wherein said web is dried to a consistency of at least about 60 percent on said heated cylinder prior to being creped.

6. The method according to claim 5, wherein said web is dried to a consistency of at least about 70 percent on said heated cylinder prior to being creped.

7. The method according to claim 1, wherein said web, after creping, exhibits a characteristic void volume of at least about 6 gms/gm after creping.

8. The method according to claim 7, wherein said web, after creping, exhibits a characteristic void volume of at least about 7 gms/gm after creping.

9. The method according to claim 1, wherein said web, after creping, exhibits a characteristic void volume of at least about 7.5 gms/gm after creping.

10. The method according to claim 1, wherein said web is creped from said heated cylinder with a creping blade defining a pocket angle of from about 50 to about 100 degrees.

11. The method according to claim 1, wherein said web is creped from said heated cylinder with a beveled creping blade.

12. The method according to claim 11, wherein said pocket angle is from about 65 to about 90 degrees.

13. The method according to claim 1, wherein said web is creped from said heated cylinder utilizing a creping blade with a beveled creping surface.

14. The method according to claim 13, wherein said creping blade has a creping bevel of from about 8 to about 12 degrees.

15. The method according to claim 13, wherein said creping blade has a creping bevel of from about 14 to about 18 degrees.

16. The method according to claim 1, wherein said web is creped from said heated cylinder with an undulatory creping blade so as to form a reticulated biaxially undulatory product with crepe bars extending in the cross direction and ridges extending in the machine direction.

17. The method according to claim 16, wherein said product comprises from about 10 to about 150 crepe bars per inch.

18. The method according to claim 17, wherein said product comprises from about 10 to about 50 ridges per inch extending in the machine direction.

19. The method according to claim 1, wherein said aqueous furnish comprises recycled fiber.

20. The method according to claim 19, wherein the recycled fiber in said aqueous furnish comprises at least about 50 percent by weight of the fiber present.

21. The method according to claim 20, wherein the recycled fiber present in said aqueous furnish comprises of at least about 75 percent by weight of the fiber present.

22. The method according to claim 21, wherein the cellulosic fiber present in said aqueous furnish consists of recycled fiber.

23. The method according to claim 1, wherein said heated gaseous medium is heated by way of combustion.

24. The method according to claim 1, wherein said heated gaseous medium is heated with IR radiation.

25. The method according to claim 1, wherein said web is wet-shaped subsequent to creping and prior to being dried with impinging air by way of vacuum-molding in an impression fabric.

26. A method of making absorbent sheet from cellulosic fiber comprising:

(a) depositing an aqueous cellulosic furnish on a foraminous support;

(b) compactively dewatering said furnish to form a web;

(c) applying said web to a heated rotating cylinder;

(d) maintaining the surface of said rotating cylinder at an elevated temperature relative to its surroundings so as to produce a moisture gradient over the thickness of said web;

(e) drying said web on said cylinder to a consistency of between about 40 and about 80 percent;

(f) creping said web from said cylinder, wherein s aid creping is operative to delaminate said web and optionally wet-shaping said web wherein said web is suitable for impingement-air drying; and (g) drying said web with an impinging heated gaseous medium to form a finished product.

27. The method according to claim 26, wherein the surface of said heated cylinder is maintained at a temperature of from about 150° F. to about 300° F.

28. The method according to claim 27, wherein the side of the web adjacent to heated cylinder is between about 180 degrees F. and 230 degrees F. upon creping.

29. The method according to claim 28, wherein steam is supplied to said heated cylinder at a pressure of from about 50 to about 150 psig.

30. The method according to claim 29, wherein steam is supplied to said heated cylinder at a pressure of at least about 100 psig.

31. The method according to claim 26, wherein said step of drying said web with said heated impinging gaseous drying medium comprises passing the web through at least one single-wire draw dryer group after creping, each of said at least one single-wire dryer group including first and second rows of web-supporting members and a single drying wire for carrying the web alternating between one of said members in said first row and one of said members in said second row, arranging an impingement-drying device in opposed relationship to at least one of said members in said at least one single-wire draw dryer group; and directing heated air from said impingement-drying device toward the web as the web runs over said at least one member.

32. The method of claim 31, wherein said members in said first row in a first one of said at least one single-wire draw dryer group in a running direction of the web constitute reversing cylinders and said members in said second row in said first single-wire draw dryer group constitute drying cylinders, further comprising the steps of:

arranging said second row of drying cylinders below said first row of reversing cylinders such that said first single-wire draw dryer group constitutes an inverted single-wire draw dryer group, said impingement-drying device being arranged in opposed relationship to at least one of said reversing cylinders in said first row of said inverted single-wire draw dryer group;

guiding the web over a first one of said drying cylinders in said second row of said inverted single-wire draw dryer group; and passing the web from said inverted single-wire draw dryer group into a twin-wire draw dryer group including first and second rows of drying cylinders, a first drying wire for carrying the web over said first row of drying cylinders and a second drying wire for carrying the web over said second row of drying cylinders.

33. The method according to claim 32, wherein said impinging air is heated to a temperature of from about 150° F. to about 300° F.

34. The method according to claim 32, wherein said impinging air is heated by way of combustion.

35. The method according to claim 32, wherein said impinging air is heated by way of IR radiation.

36. The method according to claim 26, wherein said web, after creping, exhibits a characteristic void volume of at least about 6 gms/gm after creping.

37. The method according to claim 36, wherein said web, after creping, exhibits a characteristic void volume of at least about 7 gms/gm after creping.

38. The method according to claim 37, wherein said web, after creping, exhibits a characteristic void volume of at least about 7.5 gms/gm after creping.

* * * * *